US011161338B2

(12) United States Patent
Nakano et al.

(10) Patent No.: US 11,161,338 B2
(45) Date of Patent: Nov. 2, 2021

(54) LIQUID DISCHARGING APPARATUS

(71) Applicant: Brother Kogyo Kabushiki Kaisha, Nagoya (JP)

(72) Inventors: Yasuhiro Nakano, Nagoya (JP); Zenichiro Sasaki, Nagoya (JP); Yuta Toda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 29 days.

(21) Appl. No.: 16/830,499

(22) Filed: Mar. 26, 2020

(65) Prior Publication Data

US 2020/0307177 A1 Oct. 1, 2020

(30) Foreign Application Priority Data

Mar. 26, 2019 (JP) ..... JP2019-058053

(51) Int. Cl.
*B41J 2/045* (2006.01)
*B41J 2/165* (2006.01)

(52) U.S. Cl.
CPC ..... *B41J 2/0451* (2013.01); *B41J 2/16579* (2013.01)

(58) Field of Classification Search
CPC ..... B41J 2/0451; B41J 2/16579
See application file for complete search history.

(56) References Cited

U.S. PATENT DOCUMENTS

2002/0027575 A1 3/2002 Bruch et al.
2007/0139461 A1 6/2007 Izuo
2011/0181652 A1* 7/2011 Komatsu ..... B41J 2/125 347/19
2014/0300657 A1 10/2014 Ike

FOREIGN PATENT DOCUMENTS

EP 1147910 A1 * 10/2001 ..... B41J 29/393
JP 2002-011871 A 1/2002
JP 2004-050450 A 2/2004
JP 2007-320288 A 12/2007
JP 2010-214869 A 9/2010
JP 4929699 B2 5/2012
JP 6231759 B2 11/2017

* cited by examiner

*Primary Examiner* — Sharon Polk
(74) *Attorney, Agent, or Firm* — Banner & Witcoff, Ltd.

(57) ABSTRACT

A liquid discharging apparatus includes: a liquid discharging head having nozzles; a purge mechanism which performs purge of discharging liquid from the nozzles; a signal outputting circuit which outputs signals depending on whether each of the nozzles is a failure nozzle which does not satisfy a predetermined discharging performance; a memory which stores, with respect to each of the nozzles, a value of an failure parameter regarding a number of times each of the nozzles is continuously determined to be the failure nozzle; and a controller. The controller performs failure nozzle determination with respect to at least a part of the nozzles as to whether each of at least the part of the nozzles is the failure nozzle, based on a signal from the signal outputting circuit, and updates the value of the failure parameter in the memory, based on a result of the failure nozzle determination.

20 Claims, 19 Drawing Sheets

| A | 0≦A<1 | 1≦A<2 | ··· | At-2≦A<At-1 | At-1≦A<At |
|---|---|---|---|---|---|
| K | $K_0$ | $K_1(>K_0)$ | ··· | $K_{At-2}(>K_{At-3})$ | $K_{At-1}(>K_{At-2})$ |

Fig. 13B

| N | 1 | 2 | ··· | Nm-1 | Nm |
|---|---|---|---|---|---|
| J | $J_1$ | $J_2(> J_1)$ | ··· | $J_{Nm-1}(> J_{Nm-2})$ | $J_{Nm}(> J_{Nm-1})$ |

LIQUID DISCHARGING APPARATUS

CROSS REFERENCE TO RELATED APPLICATION

The present application claims priority from Japanese Patent Application No. 2019-058053, filed on Mar. 26, 2019, the disclosure of which is incorporated herein by reference in its entirety.

BACKGROUND

Field of the Invention

The present disclosure relates to a liquid discharging apparatus which discharges liquid from nozzles.

Description of the Related Art

As an example of the liquid discharging apparatus which discharges liquid from nozzles, Japanese Patent Application Laid-open No. 2010-214869 describes a printer which performs recording of an image by discharging ink from nozzles. In a case that the printer receives a print job, the printer performs a nozzle inspection of determining the presence or absence of any discharge-failure nozzle (unsatisfactory discharge nozzle) from which the ink is not discharged in a normal manner, by discharging the ink from each of the nozzles of a print head. In a case that there is any discharge-failure nozzle, the printer performs cleaning. Further, after the cleaning, the printer performs the nozzle inspection again, and repeats the cleaning either until there is no discharge-failure nozzle or until the number of times of the cleaning performed reaches a predetermined number of times.

SUMMARY

In the above-described printer, for example, a nozzle wherein the viscosity of the ink inside the nozzle is increased is determined to be the discharge-failure nozzle. In such a case, the discharge failure of the nozzle is resolved by performing the cleaning. On the other hand, there is such a situation that several nozzles are determined to be the discharge-failure nozzles in a case, for example, that there is any flaw, scratch, damage, etc., in a nozzle surface, of the print head, formed with the nozzles, etc. In this case, even when the cleaning is performed, the discharge failure at such nozzle(s) is not resolved. Further, in the above-described printer, in a case that any flaw or damage, etc., in the nozzle surface causes the nozzle to be determined as the discharge failure nozzle, the cleaning is repeated for many times (for the predetermined number of times), thereby discharging the ink in a wasteful manner or unnecessarily.

An object of the present disclosure is to provide a liquid discharging apparatus capable of identifying an unrecoverable nozzle which becomes unrecoverable and of suppressing a discharge amount of liquid.

According to an aspect of the present disclosure, there is provided a liquid discharging apparatus including: a liquid discharging head having nozzles; a purge mechanism configured to perform purge of causing liquid inside the liquid discharging head to be discharged from the nozzles; a signal outputting circuit configured to output signals depending on whether each of the nozzles is a failure nozzle which does not satisfy a predetermined discharging performance; a memory configured to store, with respect to each of the nozzles, a value of an failure parameter regarding a number of times each of the nozzles is continuously determined to be the failure nozzle; and a controller, wherein the controller is configured to: perform failure nozzle determination, with respect to at least a part of the nozzles, as to whether each of at least the part of the nozzles is the failure nozzle, based on a signal from the signal outputting circuit; and update the value of the failure parameter stored in the memory, based on a result of the failure nozzle determination, under a condition that the controller determines that the value of the failure parameter regarding a certain nozzle, included in at least the part of the nozzles, is not less than a threshold value, in a case that the purge has been performed, with respect to the certain nozzle, during a period since the controller has determined the certain nozzle to be the failure nozzle for a first time and until the controller determines the value of the failure parameter of the certain nozzle to be not less than the threshold value, the controller is configured to set the certain nozzle to be an unrecoverable nozzle which is unrecoverable by the purge, and in a case that the purge has not been performed, with respect to the certain nozzle, during the period since the controller has determined the certain nozzle to be the failure nozzle for the first time and until the controller determines the value of the failure parameter of the certain nozzle to be not less than the threshold value, the controller is configured to: control the purge mechanism to perform the purge for the certain nozzle; perform the failure nozzle determination for the certain nozzle based on the signal from the signal outputting circuit; and update the value of the failure parameter of the certain nozzle stored in the memory, based on a result of the failure nozzle determination.

In a case that the value of the failure parameter regarding the certain nozzle is not less than the threshold value, and that the purge has been performed during the period since the certain nozzle has been determined to be the failure nozzle for the first time and until the value of the failure parameter is determined to be not less than the threshold value, the controller sets the certain nozzle to be the unrecoverable nozzle. Note that in such a case that the certain nozzle is a recoverable nozzle, the certain nozzle is recovered by the purge, and the value of the failure parameter would not become not less than the threshold value. Accordingly, the above-described setting of the unrecoverable nozzle is accurate.

On the other hand, in a case that the value of the failure parameter regarding the certain nozzle is not less than the threshold value, and that the purge has not been performed during the period since the certain nozzle has been determined to be the failure nozzle for the first time and until the value of the failure parameter is determined to be not less than the threshold value, the controller performs the purge for the certain nozzle, performs the failure nozzle determination again for the certain nozzle, and stores the value of the failure parameter regarding the certain nozzle in the memory, based on the result of the failure nozzle determination.

In a case that the above-described certain nozzle is the recoverable nozzle by the purge, the certain nozzle is recovered by the purge. Thus, the value of the failure parameter regarding the certain nozzle is updated to be less than the threshold value. In a case that the certain nozzle is the unrecoverable nozzle, the certain nozzle is not recovered by the purge, and thus the value of the failure parameter regarding the certain nozzle is maintained to be not less than the threshold value. Then, in this case, the certain nozzle is set to be the unrecoverable nozzle, as described above.

As described above, the present disclosure is capable of performing the identification of the unrecoverable nozzle in an accurate manner. Further, in a case that all the failure nozzles are all the unrecoverable nozzles, the nozzles are not recovered even by performing the purge. Accordingly, by not performing the purge for such unrecoverable nozzles, it is possible to suppress, as much as possible, the discharge amount of the liquid.

BRIEF DESCRIPTION OF THE DRAWINGS

FIG. 13B is an explanatory view of a table in which a number of times N of continuously determined to be a failure nozzle and coefficients are associated with each other.

DESCRIPTION OF THE EMBODIMENTS

In the following, an embodiment of the present disclosure will be explained.

<Overall Configuration of Printer>

Figure 1:
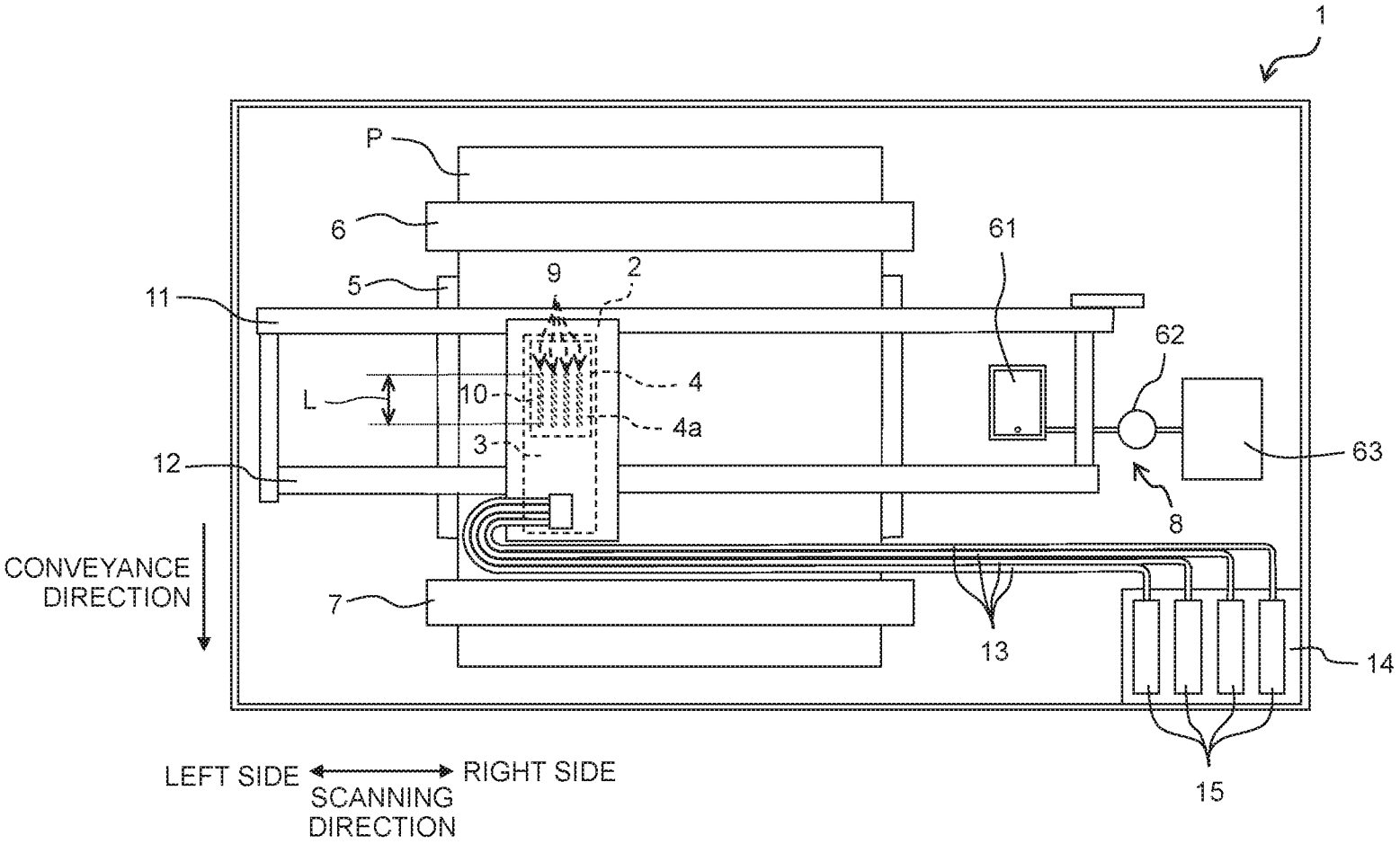
FIG. 1 is a view schematically depicting a configuration of a printer according to an embodiment of the present disclosure.

As depicted in FIG. 1, a printer 1 according to the present embodiment (corresponding to a "liquid discharging apparatus" of the present disclosure) is provided with carriage 2, a sub tank 3, an ink-jet head 4 (corresponding to a "liquid discharging head" of the present disclosure), a platen 5, conveyance rollers 6 and 7 (corresponding to a "conveyor" of the present disclosure), a maintenance unit 8, etc.

The carriage 2 is supported by two guide rails 11 and 12 extending in a scanning direction. The carriage 2 is connected to a carriage motor 86 (see FIG. 6) via a non-depicted belt, etc.; in a case that the carriage motor 86 is driven, the carriage 2 moves in the scanning direction along the guide rails 11 and 12. Note that in the following explanation, the right side and the left side in the scanning direction will be defined as depicted in FIG. 1.

The sub tank 3 is attached to the carriage 3. In this case, a cartridge holder 14 is provided on the printer 1, and four ink cartridges 15 are detachably installed in the cartridge holder 14. Black, yellow, cyan, and magenta inks are stored in the four ink cartridges 15, respectively, in this order from an ink cartridge 15, among the four ink cartridges 15, arranged on the right side in the scanning direction. The sub tank 3 is connected to the four ink cartridges 15 installed in the cartridge holder 14 via four tubes 13, respectively. With this, the four color inks are supplied from the four ink cartridges 15 to the sub tank 3.

The ink-jet head 4 is attached to the carriage 2. The four color inks are supplied to the ink-jet head 4 from the sub tank 3. Further, the ink-jet head 4 discharges or jets the inks from a plurality of nozzles 10 formed in a nozzle surface 4*a* which is a lower surface of the ink-jet head 4. To provide more specific explanation, the plurality of nozzles 10 are aligned in a row over a length L in a conveyance direction which is orthogonal to the scanning direction to thereby form a nozzle row 9; the ink-jet head 4 has four pieces of the nozzle row 9 which are arranged side by side in the scanning direction. The black, yellow, cyan, and magenta inks are discharged from the plurality of nozzles 10 in this order from nozzles, among the plurality of nozzles 10, constructing a nozzle row 9 which is included in the four nozzle rows 9 and which is arranged on the right side in the scanning direction.

The platen 5 is arranged at a position below or under the ink-jet head 4 and faces (is opposite to) the plurality of nozzles 10. The platen 5 extends in the scanning direction over the entire length of a recording sheet P (corresponding to a "recording medium" of the present disclosure) and supports the recording sheet P from therebelow. The conveyance roller 6 is located on the upstream side in the conveyance direction with respect to the ink-jet head 4 and the platen 5. The conveyance roller 7 is located on the downstream side in the conveyance direction with respect to the ink-jet head 4 and the platen 5. The conveyance rollers 6 and 7 are connected to a conveying motor 87 (see FIG. 6) via non-illustrated gears, etc. In a case that the conveying motor 87 is driven, the conveyance rollers 6 and 7 are rotated so as to convey the recording sheet P in the conveyance direction.

The maintenance unit 8 is configured to performs a suction purge, as will be described later on, so as to discharge the ink(s) in the inside of the ink-jet heads 4 from the plurality of nozzles 10. The maintenance unit 8 will be described in detail later on.

<Ink-Jet Head>

Figure 2:
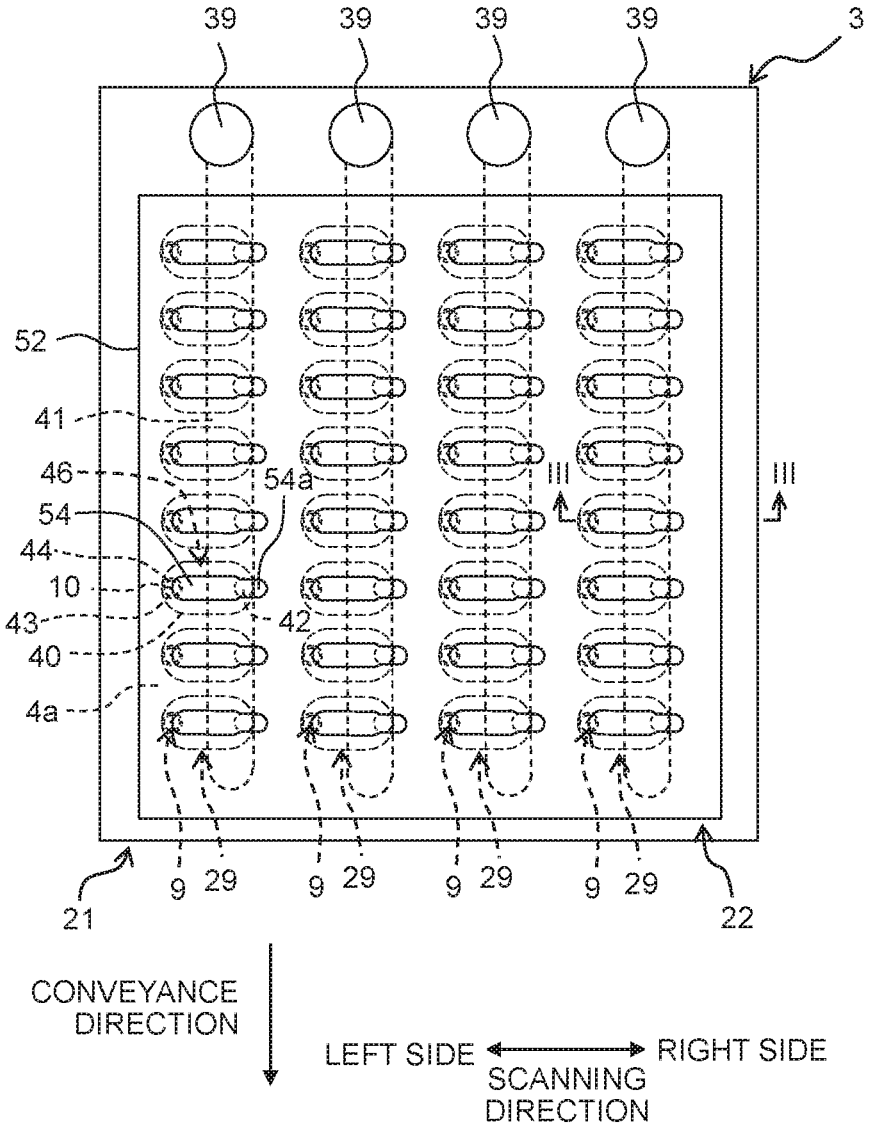
FIG. 2 is a plan view of an ink-jet head in FIG. 1.
Figure 3:
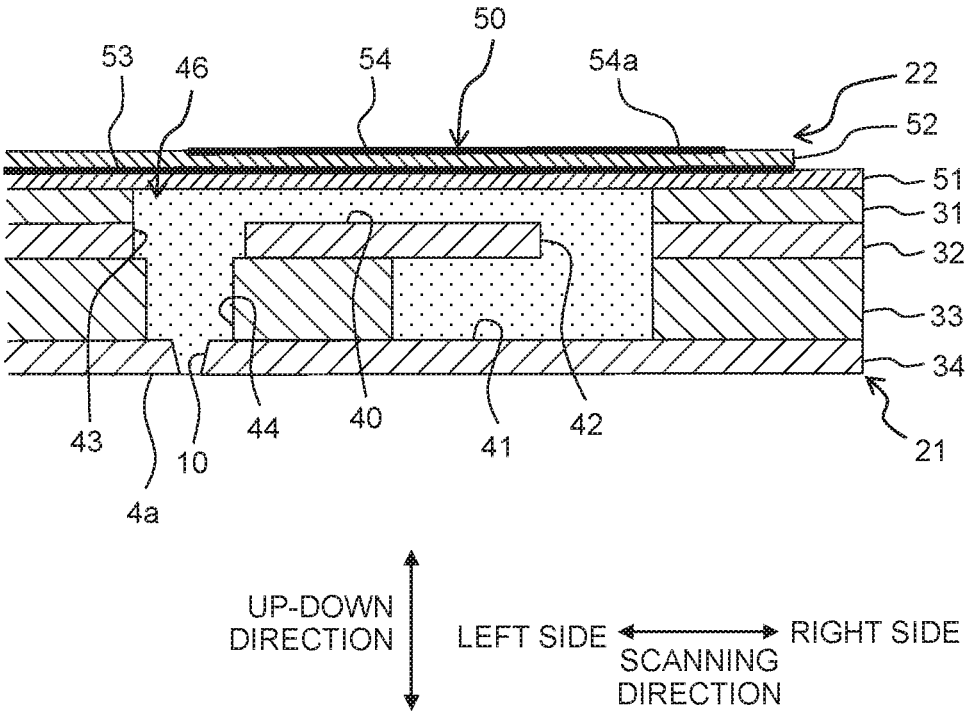
FIG. 3 is a cross-sectional view taken along a line III-III in FIG. 2.

Next, the ink-jet head 4 will be explained in detail. As depicted in FIGS. 2 and 3, the ink-jet head 4 is provided with a channel unit 21 and a piezoelectric actuator 22.

<Channel Unit>

The channel unit 21 is formed by stacking four plates 31 to 34 from an upper position in this order. The plates 31 to 33 are formed of a metallic material such as stainless steel. The plate 34 is formed of a synthetic resin material such as polyimide.

The plurality of nozzles 10 are formed in the plate 34. The plurality of nozzles 10 form the four nozzle rows 9, as described above. Further, the lower surface of the plate 34 is the nozzle surface 4*a* of the ink-jet head 4. The plate 31 is formed with a plurality of pressure chambers 40. Each of the pressure chambers 40 has a shape which is elliptical in a plan view and of which longitudinal direction is the scanning direction. Further, the plurality of pressure chambers 40 are provided individually with respect to the plurality of nozzles 10, respectively; a left end part in the scanning direction of each of the pressure chambers 40 overlaps, in the up-down direction, with one of the nozzles 10. With this, the plate 31 has four pressure chamber rows 29 which are formed of the plurality of pressure chambers 40 aligned in the conveyance direction, and which are arranged side by side in the scanning direction.

The plate 32 is formed with circular-shaped through holes 42 at parts, of the plate 32, each of which overlaps, in the up-down direction, with a right end part in the scanning direction of one of the pressure chambers 40. Further, the plate 32 is formed with circular-shaped through holes 43 at parts, of the plate 32, each of which overlaps, in the up-down direction, with a left end part in the scanning direction of one of the pressure chambers 40 and with one of the nozzles 10.

Four manifold channels 41 are formed in the plate 33. The four manifold channels 41 correspond to the four pressure chamber rows 29, respectively. Each of the manifold channels 41 extends in the conveyance direction and overlaps, in the up-down direction, with right ends part of the pressure chambers 40 constructing one of the pressure chamber rows 29 corresponding thereto. With this, each of the pressure chambers 40 is communicated with the manifold channel 41 via one of the through holes 42. Further, supply ports 39 are provided each on an end part on the upstream side in the scanning direction of one of the manifold channels 41. The ink-jet head 4 is connected to channels inside the sub tank 3 at the supply ports 39. With this, the inks are supplied to the manifold channels 41 from the supply ports 39, respectively. Furthermore, the plate 33 is formed with circular-shaped through holes 44 at parts of the plate 33, respectively, each of which overlaps, in the up-down direction, with one of the through holes 43 and one of the nozzles 10. With this, the nozzles 10 are communicated with the pressure chambers 40 via the through holes 43 and 44, respectively.

Moreover, in the channel unit 21, an individual channel 46 is formed of the nozzle 10, the pressure chamber 40, the through holes 43 and 44 connecting the nozzle 10 to the pressure chamber 40, and the through hole 42 connecting the pressure chamber 40 to the manifold channel 41. Further, a plurality of pieces of the individual channel 46 corresponding to each of the nozzle rows 9 are connected to one of the manifold channels 41 to which the plurality of individual channels 46 correspond.

<Piezoelectric Actuator>

The piezoelectric actuator 22 is provided with a vibration plate 51, a piezoelectric layer 52, a common electrode 53 and a plurality of individual electrodes 54. The vibration plate 51 is formed of a piezoelectric material containing, as a main component thereof, lead zirconate titanate which is a mixed crystal of lead titanate and lead zirconate, is arranged on the upper surface of the channel unit 21, and covers the plurality of pressure chambers 40. Note that unlike the piezoelectric layer 52 which is to be explained next, the vibration plate 51 may be formed of an insulative material which is different from the piezoelectric material.

The piezoelectric layer 52 is formed of the above-described piezoelectric material, is arranged on the upper surface of the vibration plate 51, and extends continuously over the plurality of pressure chambers 40. The common electrode 53 is arranged between the vibration plate 51 and the piezoelectric layer 52, and extends continuously over the plurality of pressure chambers 40. The common electrode 53 is connected to a non-depicted power source circuit via a non-depicted wiring member, etc., and is maintained at the ground potential.

The plurality of individual electrodes 54 are provided individually with respect to the plurality of pressure chambers 40, respectively. Each of the plurality of individual electrodes 54 has an elliptic shape in a plan view which is smaller to some extent than one of the plurality of pressure chambers 40, is arranged on the upper surface of the piezoelectric layer 52, and overlaps in the up-down direction with a central part of one of the plurality of pressure chambers 40. Further, a right end part in the scanning direction of each of the plurality of individual electrodes 54 extends rightward in the scanning direction up to a location at which the right end part does not overlap, in the up-down direction, with one of the plurality of pressure chambers 40; a forward or tip end part of the right end part in the scanning direction of each of the plurality of individual electrodes 54 becomes a connection terminal 54. A non-depicted wiring member is connected to the connection terminal 54*a*, and each of the plurality of individual electrodes 54 is connected to a driver IC 59 (see FIG. 6) via the non-depicted wiring member. Further, either one of the ground potential or a predetermined driving potential (for example, approximately 20V) is selectively applied by the driver IC 59 individually to each of the plurality of individual electrodes 54.

Further, corresponding to the above-described arrangement of the common electrode 53 and the plurality of individual electrodes 54, parts, of the piezoelectric layer 52, each of which is sandwiched between the common electrode 53 and one of the plurality of individual electrodes 54, are each polarized in a thickness direction thereof. Further, in the piezoelectric actuator 22 having the above-described configuration, the parts, of the vibration plate 51, the piezoelectric layer 52 and the common electrode 53, overlapping with the pressure chambers 40 in the up-down direction and the individual electrodes 54 form driving elements 50 applying the pressure to the ink inside the pressure chambers 40.

Here, an explanation will be given about a method of driving the piezoelectric actuator 22 and to discharge the ink from each of the nozzles 10. In the piezoelectric actuator 22, all the individual electrodes 54 are previously maintained at the ground potential same as the common electrode 53. In a case of causing the ink to be discharged from a certain nozzles 10, among the plurality of nozzles 10, the potential of the individual electrode 54 in a certain driving element 50, among the driving elements 50, corresponding to the certain nozzle 10, is switched from the ground potential to the driving potential. Then, due to the difference in potential between the individual electrode 54 and the common electrode 53, an electric field in the thickness direction parallel to the polarization direction is generated in a part, of the piezoelectric layer 52, which is sandwiched by the individual electrode 54 and the common electrode 53. Due to this electric field, the above-described part of the piezoelectric layer 52 contracts in the horizontal direction, thereby deforming parts, of the vibration plate 51 and the piezoelectric layer 52, respectively, which overlap with a certain pressure chamber 40, among the plurality of pressure chamber 40, corresponding to the certain nozzle 10 to project as a whole toward the side of the certain pressure chamber 40. The deformation decreases the volume of the certain pressure chamber 40, which in turn increase the pressure of the ink inside the certain pressure chamber 40, thereby discharging the ink from the certain nozzle 10 communicating with the certain pressure chamber 40.

<Maintenance Unit>

Next, the maintenance unit 8 will be explained. As depicted in FIG. 1, the maintenance unit 8 is provided with a cap 61, a suction pump 62 and a waste liquid tank 63. The cap 61 is arranged on the right side in the scanning direction relative to the platen 5. Further, in a case that the carriage 2 is positioned at a maintenance position located on the right side in the scanning direction relative to the platen 5, the plurality of nozzles 10 face (are opposite to) the cap 61.

Further, the cap 61 is capable of being raised and lowered (ascended/descended, moving in the up/down direction) by a cap ascending/descending mechanism 88 (see FIG. 6); in a case that the cap 61 is raised by the cap ascending/descending mechanism 88 in a state that the carriage 2 is positioned at the maintenance position and that the plurality of nozzles 10 face the cap 61, an upper end part of the cap 61 makes tight contact with the nozzle surface 4*a* of the ink-jet head 4 so as to cover the plurality of nozzles 10 with the cap 61. Note that the cap 61 is not limited to or restricted by being a cap which makes tight contact with the nozzle surface 4*a* to thereby cover the plurality of nozzles 10. The cap 61 may be, for example, configured to make tight contact with a non-depicted frame, etc., which is arranged to surround the nozzle surface 4*a* of the ink-jet head 4, to thereby cover the plurality of nozzles 10.

The suction pump 62 is, for example, a tube pump, etc., and is connected to the cap 61 and the waste liquid tank 63. Further, in the maintenance unit 8, in a case that the suction pump 62 is driven in a state that the plurality of nozzles 10 are covered by the cap 61 as described above, it is possible to perform a so-called suction purge wherein the ink inside the ink-jet head 4 is discharged from the plurality of nozzles 10. The ink discharged from the ink-jet head 4 is stored in the waste liquid tank 63.

Note that although the explanation has been made, for the sake of convenience, about a case that the cap 61 covers all the plurality of nozzles 10 in a collective manner, and that the ink inside the ink-jet head 4 is discharged from all the plurality of nozzles 10, the present disclosure is not limited to this case. For example, it is also allowable that the cap 61 is provided with a part covering nozzles 10 which are included in the plurality of nozzles 10 and which construct the rightmost nozzle row 9 discharging the black ink, and another part separate from the part and covering nozzles 10 which are included in the plurality of nozzles 10 and which construct the remaining left-side three nozzle rows 9 discharging color inks (yellow, cyan and magenta ink), respectively, and that the suction purge may be performed to selectively discharge either one of the black ink and the color inks in the ink-jet head 4.

Figure 4:
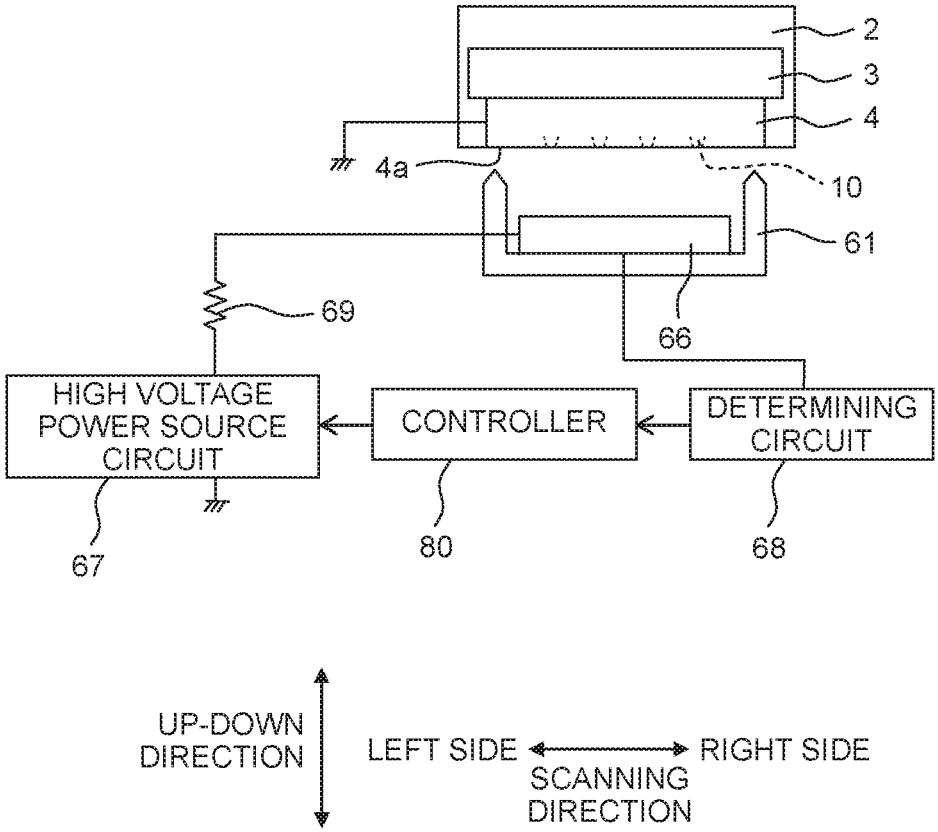
FIG. 4 is a view depicting a detecting electrode arranged inside a cap, and explaining the relationship of connection of the detecting electrode to a high voltage power source circuit and to a determining circuit.

Further, as depicted in FIG. 4, a detecting electrode 66 having a rectangular shape in a plane view is arranged inside the cap 61. The detecting electrode 66 is connected to a high voltage power source circuit 67 via a resistor 69. Further, a predetermined positive potential (for example, approximately 300 V) is imparted to the detecting electrode 66 by the high voltage power source circuit 67. On the other hand, the channel unit 21 of the ink-jet head 4 is maintained at the ground potential. With this, there is generated a predetermined difference in the potential between the ink-jet head 4 and the detecting electrode 66. A determining circuit 68 (corresponding to a "signal outputting circuit" of the present disclosure) is connected to the detecting electrode 66. The determining circuit 68 compares the voltage value of a voltage signal outputted from the detecting electrode 66 with a threshold value Vt, and outputs a signal according to the result of the comparison.

Figure 5A:
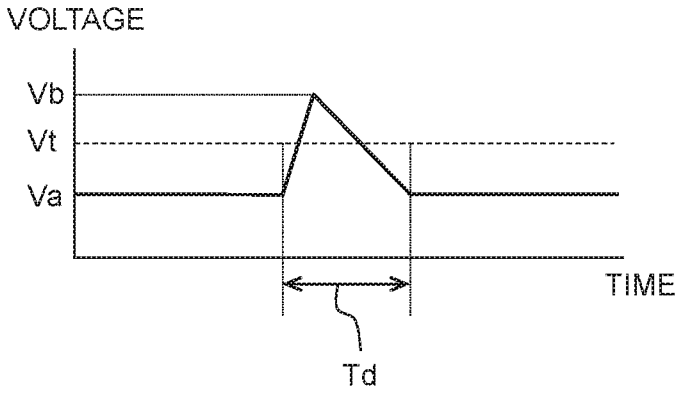
FIG. 5A is a view depicting a change in a voltage value of the detecting electrode in a case that ink is discharged from a nozzle.

To provide a more specific explanation, since the difference in the potential is generated between the ink-jet head 4 and the detecting electrode 66, the ink discharged from the nozzles 10 is charged with the electricity. As depicted in FIG. 5A, in a case that the ink or inks is discharged from the nozzles 10 toward the detecting electrode 66 in a state that the carriage 2 is positioned at the above-described maintenance position, the voltage value of the detecting electrode 66 is raised while the charged ink approaches closely to the detecting electrode 66 and until the charged ink lands on the detecting electrode 66, and the voltage value reaches a voltage value Vb which is high as compared with a voltage value Va in a state that the ink-jet head 4 is not driven. Then, after the charged ink has landed on the detecting electrode 66, the voltage value of the detecting electrode 66 is lowered gradually to the voltage value Va. Namely, in a driving period Td during which the ink-jet head 4 is driven, the voltage value of the detecting electrode 66 changes.

Figure 5B:
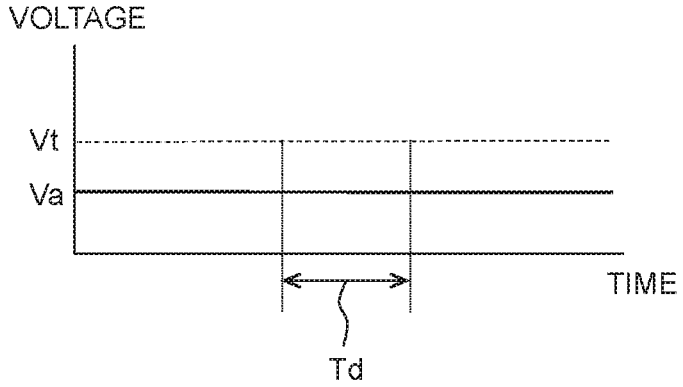
FIG. 5B is a view depicting the change in the voltage value of the detecting electrode in a case that the ink is not discharged from the nozzle.

On the other hand, in a case that the ink is not discharged from the nozzles 10, the voltage value of the voltage signal outputted from the detecting electrode 66 hardly changes during the driving period Td of the ink-jet head 4, as depicted in FIG. 5B. In view of this, a threshold value Vt ($Va<Vt<Vb$) is set in the determining circuit 68 so as to discriminate or distinguish these voltage values in the above two cases. Further, the determining circuit 68 compares a maximum voltage value of the voltage signal outputted from the detecting electrode 66 and the threshold value Vt during the driving period Td of the ink-jet head 4, and outputs a signal in accordance with the result of the determination.

Note that in this case, although the positive potential is imparted to the detecting electrode 66 by the high voltage power source circuit 67, it is also allowable that a negative potential (for example, approximately −300 V) is imparted to the detecting electrode 66 by the high voltage power source circuit 67. In such a case, contrary to the above-described case, the ink or inks is (are) discharged from the nozzles 10 toward the detecting electrode 66 in the state that the carriage 2 is positioned at the above-described maintenance position, then the voltage value of the detecting electrode 66 is lowered while the charged ink approaches closely to the detecting electrode 66 and until the charged ink lands on the detecting electrode 66.

<Electrical Configuration of Printer>

Figure 6:
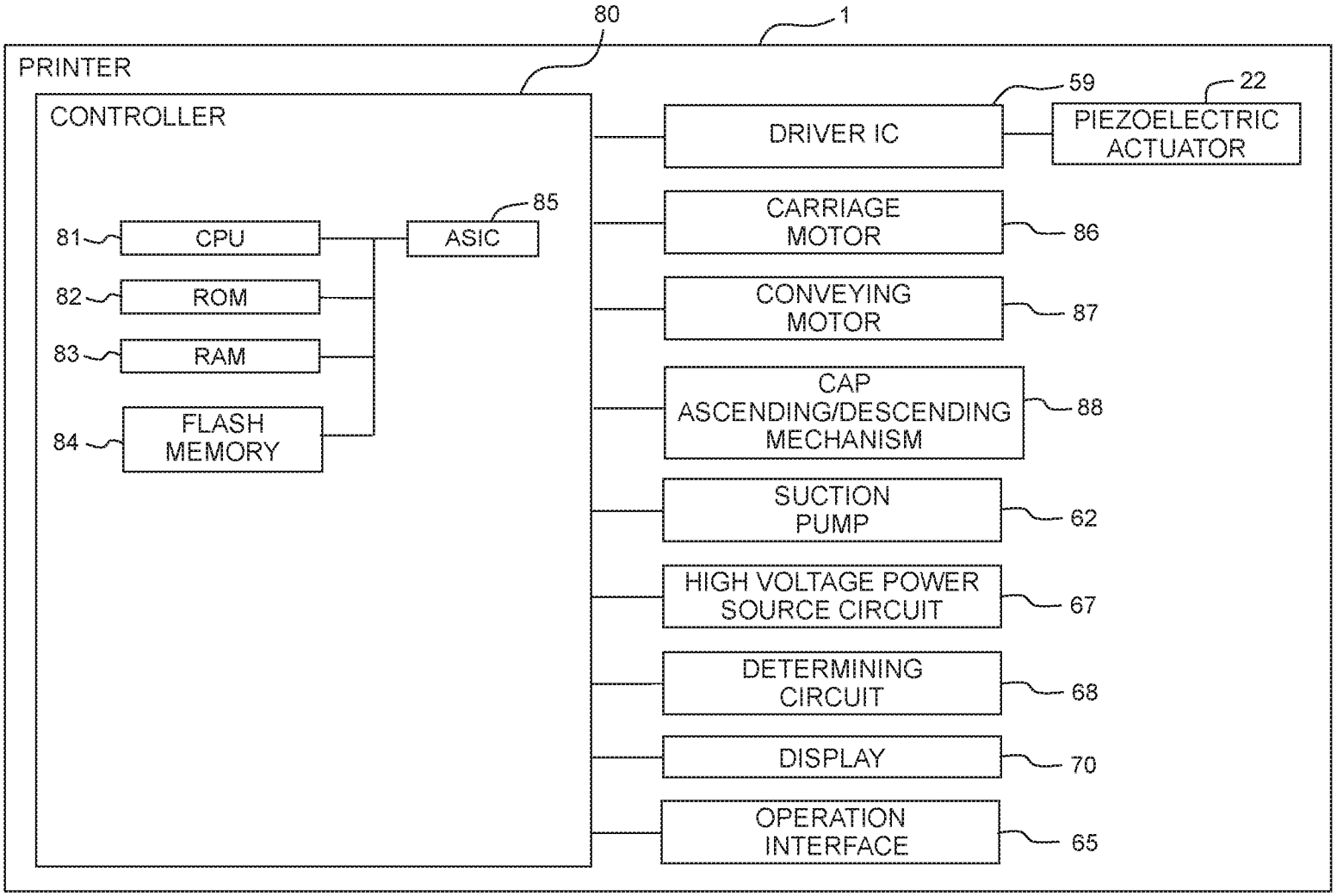
FIG. 6 is a block diagram depicting the electrical configuration of the printer.

Next, an explanation will be given about the electrical configuration of the printer 1. The operation of the printer 1 is controlled by a controller 80. As depicted in FIG. 6, the controller 80 includes a CPU (Central Processing Unit) 81, a ROM (Read Only Memory) 82, a RAM (Random Access Memory) 83, a flash memory 84, an ASIC (Application Specific Integrated Circuit) 85, etc., and these components or elements control the carriage motor 86, the conveying motor 87, the driver IC 59, the cap ascending/descending mechanism 88, the high voltage power source circuit 67, the suction pump 62, etc. Further, the above-described signal is inputted from the determining circuit 68 to the controller 80.

In addition to the above-described configuration, the printer 1 is provided with a display part 70 such as display (corresponding to a "notifying part" of the present disclosure), and the controller 80 controls the displaying part 70. Furthermore, the printer 1 is provided with an operation interface 65 such as a switch, touch panel, etc. The operation interface 65 transmits a signal according to an operation by a user to the controller 80.

Note that in the controller 80, it is allowable that only the CPU 81 performs the respective processings. Alternatively, it is allowable that only the ASIC 85 performs the respective processings, or that the CPU 81 and the ASIC 85 perform the respective processing in a cooperative manner Still alternatively, in the controller 80, it is allowable that one CPU singly performs the respective processing, or that a plurality of pieces of the CPU 81 perform the processings in a sharing manner. Alternatively, in the controller 80, it is allowable that one ASIC 85 singly performs the respective processing, or that a plurality of pieces of the ASIC 85 perform the processings in a sharing manner <Control During Recording>

Figure 7:
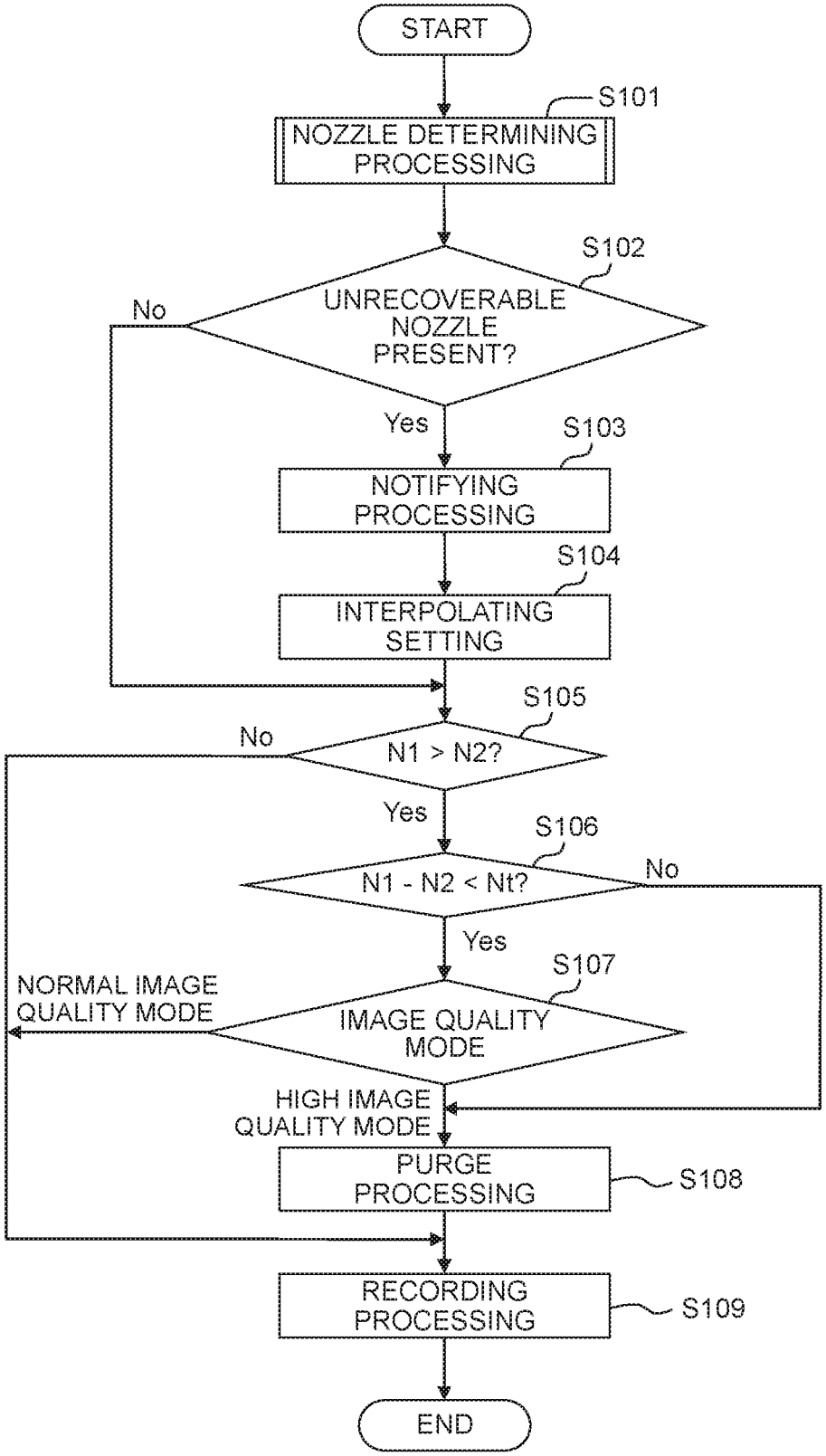
FIG. 7 is a flow chart depicting the flow of a processing during recording.

Next, an explanation will be given about a processing performed in the printer 1 in a case of recording an image on a recording sheet P. In the printer, 1, the controller 80 performs the processing in accordance with the flow depicted in FIG. 7 to thereby record an image, etc., on the recording sheet P. The flow of FIG. 7 is started in a case that a recording instruction (recording command) to instruct the recording of an image is inputted.

Figure 8:
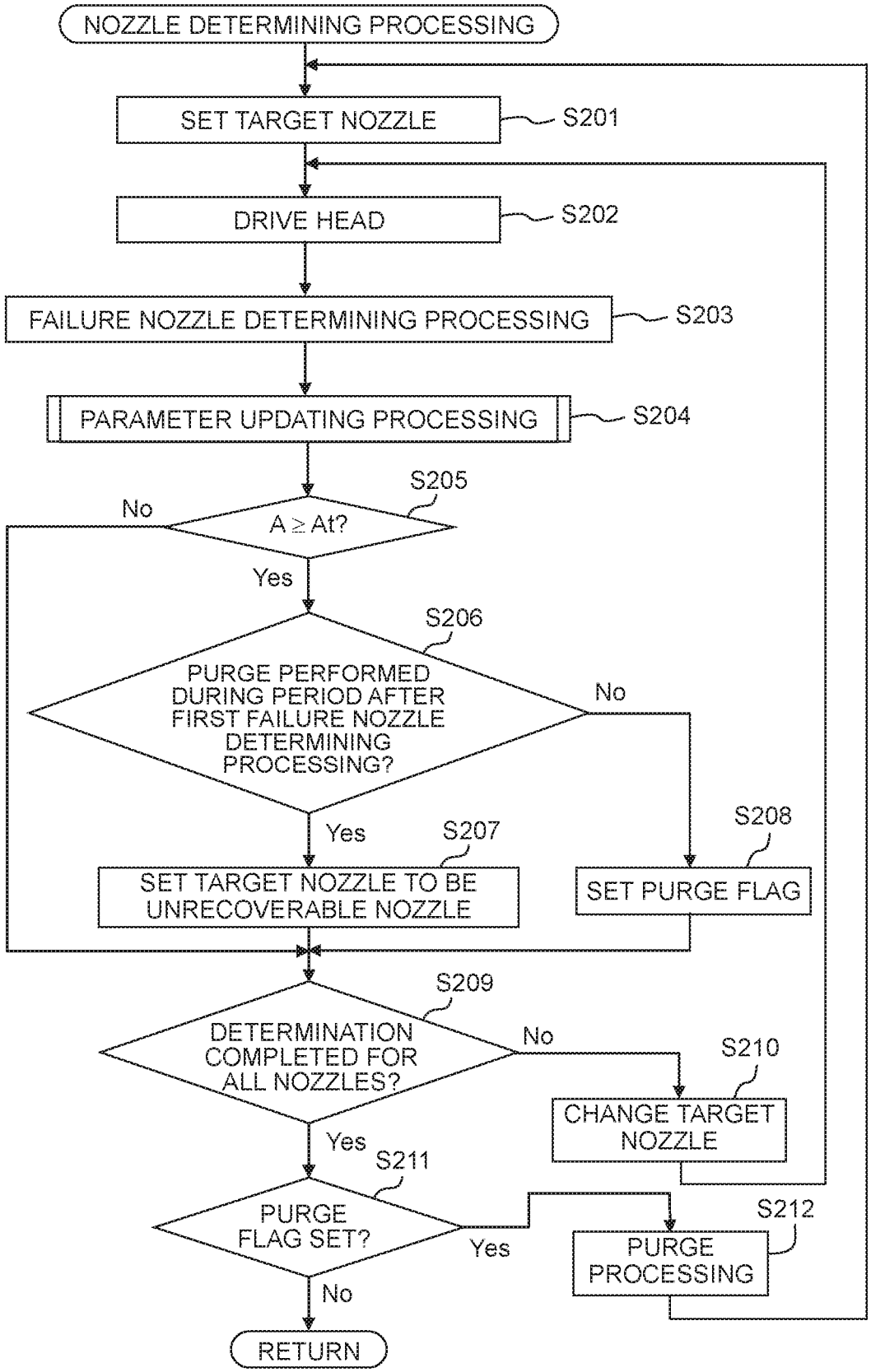
FIG. 8 is a flow chart depicting the flow of a nozzle determining processing in FIG. 7.

The flow in FIG. 7 will be explained in detail. In a case that the recording instruction is inputted, the controller 80 firstly execute a nozzle determining processing (step S101). In the nozzle determining processing, as depicted in FIG. 8, the controller 80 firstly set a nozzle 10 among the plurality of nozzles 10 as a target nozzle which is a target of a determination as to whether or not the nozzle is a failure nozzle (hereinafter referred also to as "failure nozzle determination") (step S201). In step S201, any nozzle 10 among the plurality of nozzles 10 may be set as the target nozzle. For example, an upstream-most nozzle 10 which is included in nozzles 10 constructing a right-most nozzle row 9 located on the rightmost side among the four nozzle rows 9 and which is arranged on the upstream-most side in the conveyance direction in the right-most nozzle row 9 is set as the target nozzle.

Next, the controller 80 drives a driving element 50 which is included in the driving elements 50 and which corresponds to the target nozzle (step S202). Further, in this situation, the controller 80 executes a failure nozzle determining processing with respect to the target nozzle as to whether or not the target nozzle is the failure nozzle (whether or not the ink is discharged from the target nozzle), based on a signal outputted from the determining circuit 68 in this case (step S203).

Next, the controller 80 executes a parameter updating processing (step S204). In the parameter updating processing of step S204, the controller 80 updates a value of an failure parameter A. The failure parameter A is a parameter individually applied to each of the plurality of nozzles 10, depending on a number of times that each of the plurality of nozzles 10 is continuously determined as the failure nozzle. The value of the failure parameter A is stored in the flash memory 84 (corresponding to a "memory" of the present disclosure). Further, for example, in a producing step of the printer 1, etc., the value of the failure parameter A regarding each of the plurality of nozzles 10 is set to "0 (zero)" as an initial value.

Figure 9:
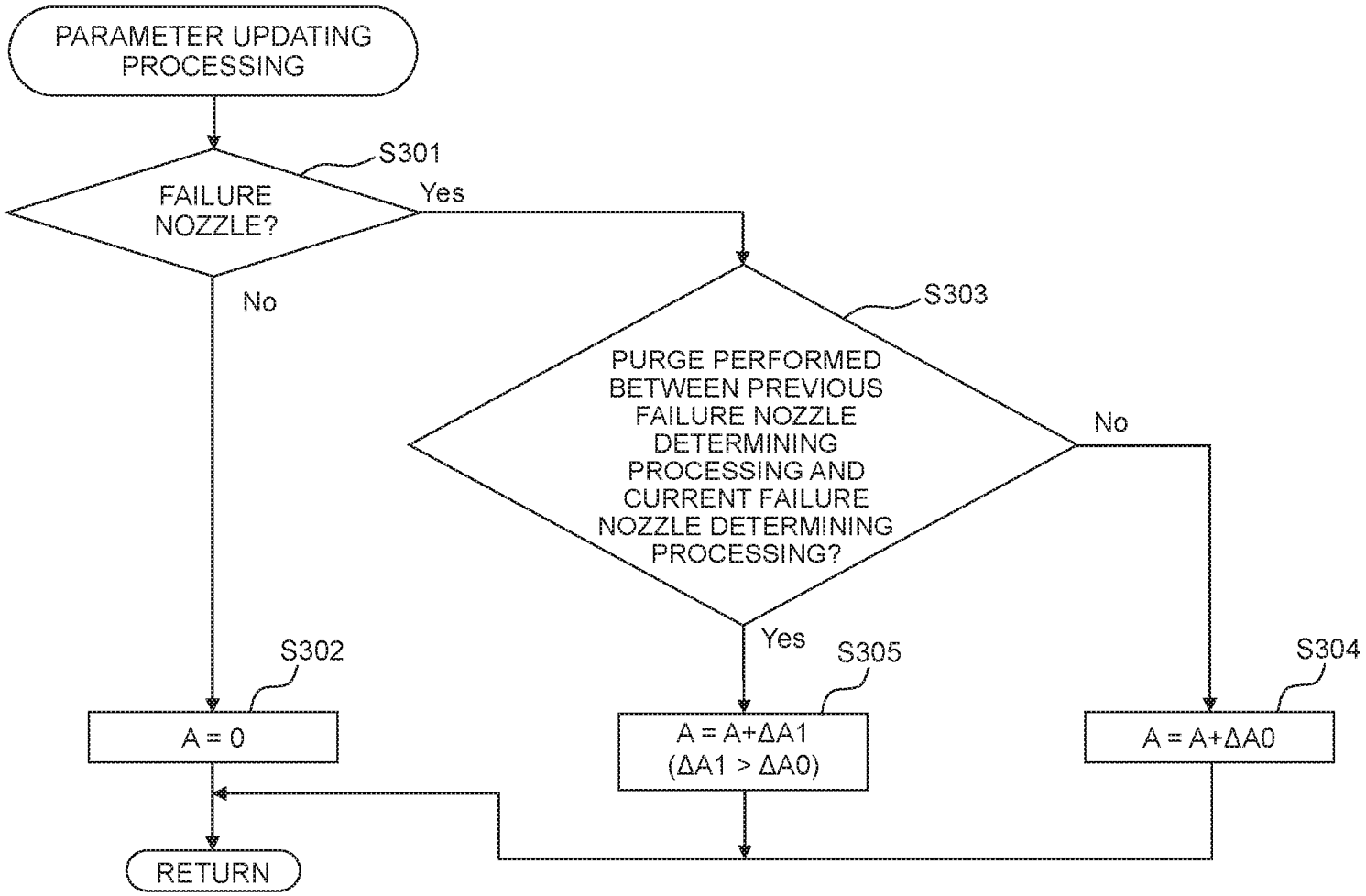
FIG. 9 is a flow chart depicting the flow of a parameter updating processing in FIG. 8.

In the parameter updating processing in step S204, as depicted in FIG. 9, in a case that the target nozzle is not the failure nozzle (step S301: NO), the controller 80 sets the value of the failure parameter A regarding the target nozzle to be 0 (zero) (step S302), and returns to the flow of FIG. 8.

On the other hand, in a case that the target nozzle is the failure nozzle (step S301: YES), and that the suction purge has not been performed during a period since the failure nozzle determination has been performed previously and until the failure nozzle determination is performed currently (step S303: NO), the controller 80 updates the value of the failure parameter A regarding the target nozzle to [A+ΔA0] (for example, ΔA0=1) (step S304), and returns to the flow of FIG. 8.

In a case that the target nozzle is the failure nozzle (step S301: YES), and that the suction purge has been performed during the period since the failure nozzle determination has been performed previously and until the failure nozzle determination is performed currently (step S303: YES), the controller 80 updates the value of the failure parameter A regarding the target nozzle to [A+ΔA1] (ΔA1>ΔA0) (step S305), and returns to the flow of FIG. 8.

Returning to FIG. 8, after the controller 80 executes the parameter updating processing in step S204, the controller 80 proceeds to step S209 in a case that the value of the failure parameter A regarding the target nozzle is less than a threshold value At (step S205: NO).

On the other hand, in a case that the value of the failure parameter A regarding the target nozzle is not less than the threshold value At (step S205: YES) and that the suction purge has been performed during the period since the target nozzle has been determined to be the failure nozzle for the first time and until the value of the failure parameter A becomes to be not less than the threshold value At (step S206: YES), the controller 80 sets the target nozzle to be an unrecoverable nozzle which is unrecoverable (which cannot be recovered) by the suction purge (step S207), and proceeds to step S209.

In contrast, in a case that the value of the failure parameter A regarding the target nozzle is not less than the threshold value At (step S205: YES), and that the suction purge has not been performed during the period since the target nozzle has been determined to be the failure nozzle for the first time and until the value of the failure parameter A becomes to be not less than the threshold value At (step S206: NO), the controller 80 sets a purge flag (step S208), and proceeds to step S209.

In step S209, the controller 80 determines as to whether or not the failure nozzle determination is completed with respect to all the plurality of nozzles 10 in the ink-jet head 4. In a case that the failure nozzle determination is not completed with respect to all the plurality of nozzles 10 in the ink-jet head 4 (step S209: NO), the controller 80 changes the target nozzle (step S210), and returns to step S202.

In step S210, a nozzle 10 for which the failure nozzle determination has not been performed yet is set to be the target nozzle. For example, in a case that a certain nozzle 10 which is included in nozzles 10 constructing a certain nozzle row 9 among the four nozzle rows 9, and which is different from another nozzle 10 positioned on the downstream-most side in the conveyance direction is set as the target nozzle, then in step S210, a nozzle 10 which is adjacent to the certain nozzle 10 on the downstream side in the conveyance direction is set as the target nozzle. Further, in another case that, for example, a downstream-most nozzle 10 which is included in the nozzles 10 constructing the certain nozzle row 9 among the four nozzle rows 9, and which is positioned on the downstream-most side in the conveyance direction is set as the target for the failure nozzle determination, then in step S210, an upstream-most nozzle 10, which is included in nozzles 10 constructing another nozzle row 9 among the four nozzle rows 9 and adjacent on the left side to the certain nozzle row 9 and which is positioned on the upstream-most side in the conveyance direction in the another nozzle row 9, is set as the target nozzle.

Then, in a case that the failure nozzle determination has been completed for all the plurality of nozzles 10 in the ink-jet head 4 (step S209: YES), and that the purge flag is set (set S211: YES), then the controller 80 executes a purge processing for performing the suction purge (step S212), and thereafter returns to step S201. On the other hand, in a case that the purge flag is not set (step S211: NO), the controller 80 returns to the flow of FIG. 7.

Returning to FIG. 7, after the nozzle determining processing in step S101, in a case that the unrecoverable nozzle is not present in the plurality of nozzles 10 in the ink-jet head 4 (step S102: NO), the controller 80 proceeds to step S105. On the other hand, in a case that the unrecoverable nozzle is present in the plurality of nozzles 10 in the ink-jet head 4 (step S102: YES), the controller 80 executes a notifying processing of causing the displaying part 70 to display a message, etc., so as to notify the user of the presence of the unrecoverable nozzle and that an interpolating setting (to be explained next) is being executed (step S103). Then, after the controller 80 executes the interpolating setting based on the position of the unrecoverable nozzle (step S104), the controller 80 proceeds to step S105.

In the printer, 1, an image, etc. is recorded on the recording sheet P by alternately executing a recording pass of discharging the ink from the plurality of nozzles 10 of the ink-jet head 4 while moving the carriage 2 in the scanning direction and a conveying operation of causing the conveying rollers 6 and 7 to convey the recording sheet P. Further, the printer 1 is capable of executing the recording of the image on the recording sheet P selectively in either one of a normal image quality mode (corresponding to a "first recording mode" of the present disclosure) and a high image quality mode (corresponding to a "second recording mode" of the present disclosure) in which the image quality is higher than that in the normal image quality mode. In the high image quality mode, for example, a spacing distance in the scanning direction between dots formed by the ink discharged in the recording pass is smaller (the resolution in the scanning direction is higher) than that in the normal image quality mode.

Further, in the interpolating setting in step S104, a conveyance amount of the recording sheet P in at least in a part of the conveying operation performed a plurality of times, and allocation of the dots, of an image to be recorded, with respect to the respective nozzles 10 in the case that the unrecoverable nozzle is present are made to be different from those in the case that the unrecoverable nozzle is not present. By doing so, the ink is discharged from another nozzle 10, which is not set to be the unrecoverable nozzle, toward an area in the recording sheet P which is allocated to the unrecoverable nozzle.

Figure 10A:
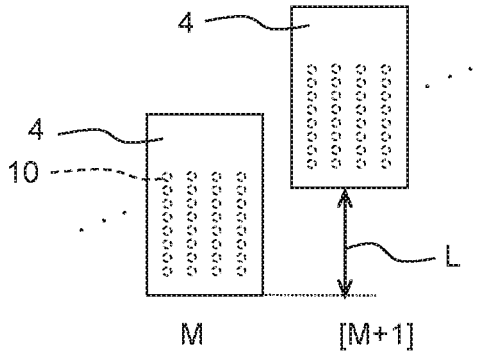
FIG. 10A is an explanatory view of the positional relationship of a recording head, with respect to continuous recording passes, in a case that any unrecoverable nozzle is not present, with a position of a recording sheet as the reference.
Figure 10B:
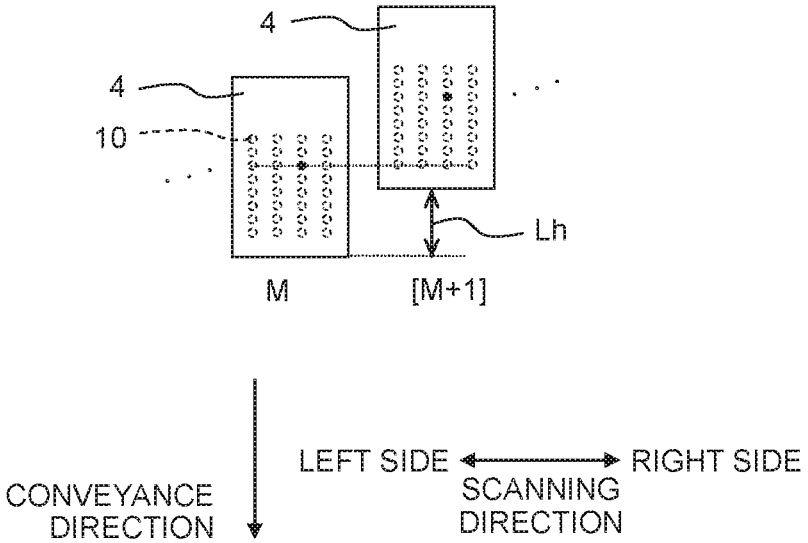
FIG. 10B is an explanatory view of the positional relationship of the recording head, with respect to the continuous recording passes, in a case that a unrecoverable nozzle is present, with the position of the recording sheet as the reference.

To provide an example, in the case that the unrecoverable nozzle is not present, as depicted in FIG. 10A, the recording sheet P is conveyed in the conveying operation by the length L of the nozzle row 9. In contrast, in a case that a solid nozzle 10 in FIG. 10B is the unrecoverable nozzle, a conveyance mount between a Mth recording pass and a [M+1]th recording pass is set to be a conveyance amount Lh which is shorter than the length L and by which a downstream-most nozzle 10, which is on the downstream-most side in the conveyance direction in the [M+1]th recording pass corresponds to a same dot as the unrecoverable nozzle (faces a same area in the recording sheet P as the unrecoverable nozzle) in the Mth recording pass. Further, in accordance with this, the allocations of the dots of the image to be recorded are set with respect to the respective nozzles 10. Here, the reference numerals "M" and "[M+1]" in FIGS. 10A and 10B indicate the Mth recording pass and the [M+1]th recording pass, respectively.

Note that although the unrecoverable nozzle is only one in the example described here, it is allowable to make the conveyance amount of the recording sheet P in at least in a part of the conveying operation performed a plurality of times, and the allocation of the dots, of the image to be recorded, with respect to the respective nozzles 10 to be different from those in the case that the unrecoverable nozzle is not present, in accordance with the number and/or location of the unrecoverable nozzle, a location (position) of a blank area, in the image to be recorded, in which any dot is not present, etc.

In step S105, it is determined as to whether or not a number N1 of the failure nozzle is greater than a number N2 of the unrecoverable nozzle. Namely, it is determined as to whether or not a nozzle 10 which is not the unrecoverable nozzle is included in the failure nozzle. Further, in a case that the number N1 of the failure nozzle is same as the number N2 of the unrecoverable nozzle (a nozzle 10 which is not the unrecoverable nozzle is not included in the failure nozzle) (step S105: NO), the controller 80 executes a recording processing, without executing the suction purge (without executing a purge processing in step S108 which is to be described later on) (step S109). In the recording processing of step S109, the controller 80 perform the recording of the image on the recording sheet P by repeatedly and alternately performing the recording pass and the conveying operation.

In a case that the number N1 of the failure nozzle is greater than the number N2 of the unrecoverable nozzle (the nozzle which is not the unrecoverable nozzle is included in the failure nozzle) (step S105: YES), the controller 80 then determines as to whether or not a value [N1−N2] obtained by deducting the number N2 of the unrecoverable nozzle from the number N1 of the failure nozzle is less than a predetermined value Nt (step S106). Note that in the present embodiment, the condition that [N1−N2] is less than the predetermined value N1 corresponds to a "purge skip condition" of the present disclosure.

Further, in a case that [N1−N2] is less than the predetermined value Nt (step S106: YES) and that the recording is to be performed in the normal image quality mode (step S107: Normal image quality mode), the controller 80 executes the recording processing (step S109) without performing the suction purge (without executing the purge processing in step S108 which will be described later on).

On the other hand, in a case that [N1−N2] is not less than the predetermined value Nt (step S106: NO), the controller 80 executes the purge processing of performing the suction purge (step S108) and thereafter the controller 80 executes the recording processing (step S109). Further, even in a case that the [N1−N2] is less than the predetermined value Nt (step S106: YES), in a case that the recording is to be performed in the high image quality mode (step S107: High image quality mode), the controller 80 executes the purge processing (step S108) and thereafter the controller 80 executes the recording processing (step S109).

<Effect>

In the present embodiment, in a case that the value of the failure parameter A regarding a certain nozzle 10 is not less than the threshold value At and that the suction purge has been performed during a period since the certain nozzle 10 has been determined to be the failure nozzle for the first time and until the value of the failure parameter A is determined to be not less than the threshold value At, the certain nozzle 10 is set to be the unrecoverable nozzle. Here, in a case that the certain nozzle 10 is a recoverable nozzle 10 which is recoverable by the suction purge, the certain nozzle 10 ceased to be the failure nozzle in a case that the suction purge is performed therefor, and the value of the failure parameter At would not become to be not less than the threshold value At. Accordingly, the above-described setting of the unrecoverable nozzle is accurate.

On the other hand, in a case that the value of the failure parameter A regarding a certain nozzle 10 is not less than the threshold value At, and that the suction purge has not been performed during the period since the certain nozzle 10 has been determined to be the failure nozzle for the first time and until the value of the failure parameter A is determined to be not less than the threshold value At, the suction purge is performed for the certain nozzle 10; after the suction purge, the failure nozzle determination is then performed for the certain nozzle 10, and the value of the failure parameter A is updated based on the result of the failure nozzle determination.

In a case that the certain nozzle 10 is a recoverable nozzle 10 which is recoverable by the suction purge, the certain nozzle 10 ceased to be the failure nozzle in a case that the certain nozzle 10 is recovered by the suction purge, and the value of the failure parameter A is updated to 0 (zero) (less than the threshold value At). On the other hand, in a case that that the certain nozzle 10 is a unrecoverable nozzle 10 which is unrecoverable by the suction purge, the certain nozzle 10 is not recovered by the suction purge, and the state that the value of the failure parameter A regarding the certain nozzle 10 is not less than the threshold value At is maintained. Further, in this case, the certain nozzle 10 is set to be the unrecoverable nozzle, as described above.

From the foregoing, the present embodiment is capable of performing the identification of the unrecoverable nozzle in an accurate manner. Further, in a case that all the failure nozzles are the unrecoverable nozzles, the failure nozzles 10 are not recovered even by performing the suction purge. Therefore, by not performing the suction purge, it is possible to suppress, as much as possible, the discharge amount of the ink. Note that this effect that the discharge amount of the ink can be suppressed as much as possible is particularly important in a case of providing a service wherein an user is charged with a fee depending on an amount of the ink used by the user (Managed Print Service), etc.

Further, in a case that the failure nozzle is not the unrecoverable nozzle, there is a high possibility that the failure nozzle might be recovered by the suction purge. Accordingly, in a case that the suction purge has been performed during a period since the failure nozzle determination has been performed previously and until the failure nozzle determination is performed currently, there is a high possibility that the nozzle 10 determined as the failure nozzle might be the recoverable nozzle, as compared with a case that the suction purge has not been performed during the above-described period. In view of this, in the present embodiment, in a case that the certain nozzle 10 is determined to be the failure nozzle and that the suction purge has been performed during the above-described period, the failure parameter A is increased to an greater extent than in a case that the certain nozzle 10 is determined to be the failure nozzle and that the suction purge has not been performed during the above-described period.

Furthermore, in the present embodiment, in the case that the unrecoverable nozzle is present, the conveyance amount of the recording sheet P in at least in a part of the conveying operation performed a plurality of times is made to be different from that in the case that the unrecoverable nozzle is not present, and the ink is caused to be discharged from another nozzle 10 which is not the unrecoverable nozzle onto an area, in the recording sheet P, corresponding to the unrecoverable nozzle. By doing so, the image quality of the image recorded can be maintained even in a case that the unrecoverable nozzle is present.

Moreover, in the present embodiment, in the case that the unrecoverable nozzle is present, it is possible to notify the user of the presence of the failure nozzle by, for example, causing the displaying part 70 to display a message, etc.

Further, in a case that the number of the failure nozzle which is not the recoverable nozzle is great, there is such a fear that the image quality of the image to be recorded might be greatly lowered if the recording of the image were performed without performing the suction purge. On the other hand, in a case that the number of the failure nozzle which is not the recoverable nozzle is small, the image quality of the image to be recorded is not so lowered even if the recording of the image were performed without performing the suction purge.

Furthermore, in a case that the recording is performed in the normal image quality mode for which any high image quality is not required, it is not problematic even if there were any failure nozzle(s) which are not the unrecoverable nozzle(s), to some extent; whereas in the high quality image mode for which a high image quality is required, if there were even a small number of the failure nozzle(s) which are not the unrecoverable nozzle(s) present, there is such a fear that any required image quality might not be obtained.

In view of the above situation, the present embodiment performs recording of an image, without performing the suction purge, in a case that the purge skip condition that [N1−N2] is less than the predetermined value Nt is satisfied and that the recording is to be performed in the normal image quality mode. By doing so, it is possible to shorten the time since the recording instruction is inputted and until the recording of an image onto the recording medium is completed.

On the other hand, in a case that the purge skip condition is not satisfied, the suction purge is performed so as to recover a failure nozzle which is not the unrecoverable nozzle, and then to perform the recording of the image. Further, in a case that even if the purge skip condition is satisfied, but that the recording is to be performed in the high quality image mode, then the suction purge is performed so as to recover a failure nozzle which is not the unrecoverable nozzle, and then to perform the recording of the image. By doing so, it is possible to prevent the image quality of the image to be recorded from lowering greatly.

<Modification>

In the foregoing, the embodiment of the present disclosure has been explained. The present disclosure, however, is not limited to or restricted by the above-described embodiment; it is allowable to make a various kind of changes to the present disclosure, within the scope described in the claims.

In the above-described embodiment, it is determined as to whether or not the purge processing in step S108, S212 is to be executed, without considering the value of the failure parameter A of the failure nozzle which is not the unrecoverable nozzle. The present disclosure, however, is not limited to this.

Figure 11:
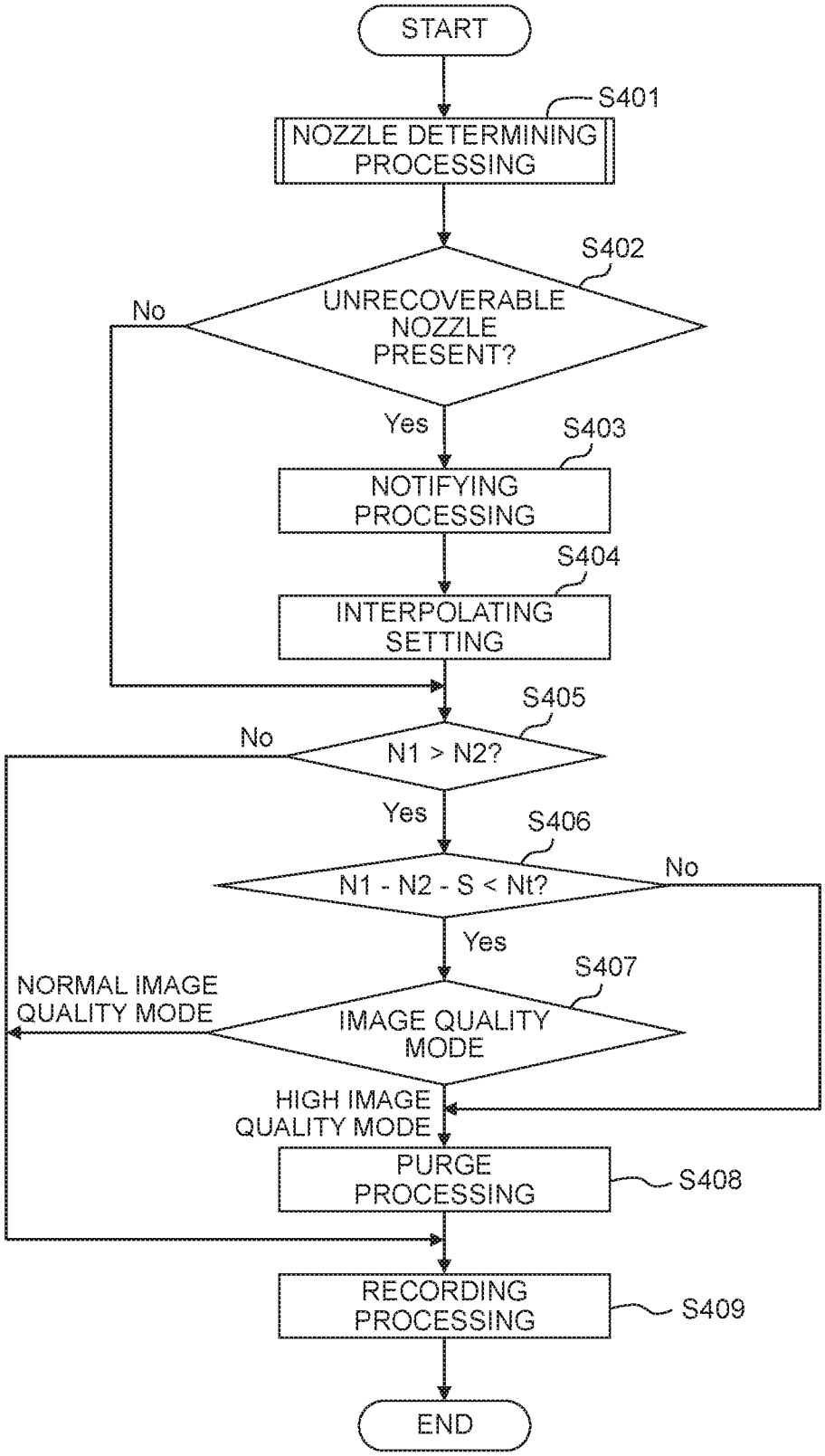
FIG. 11 is a flow chart of a first modification, corresponding to FIG. 7.
Figure 12A:
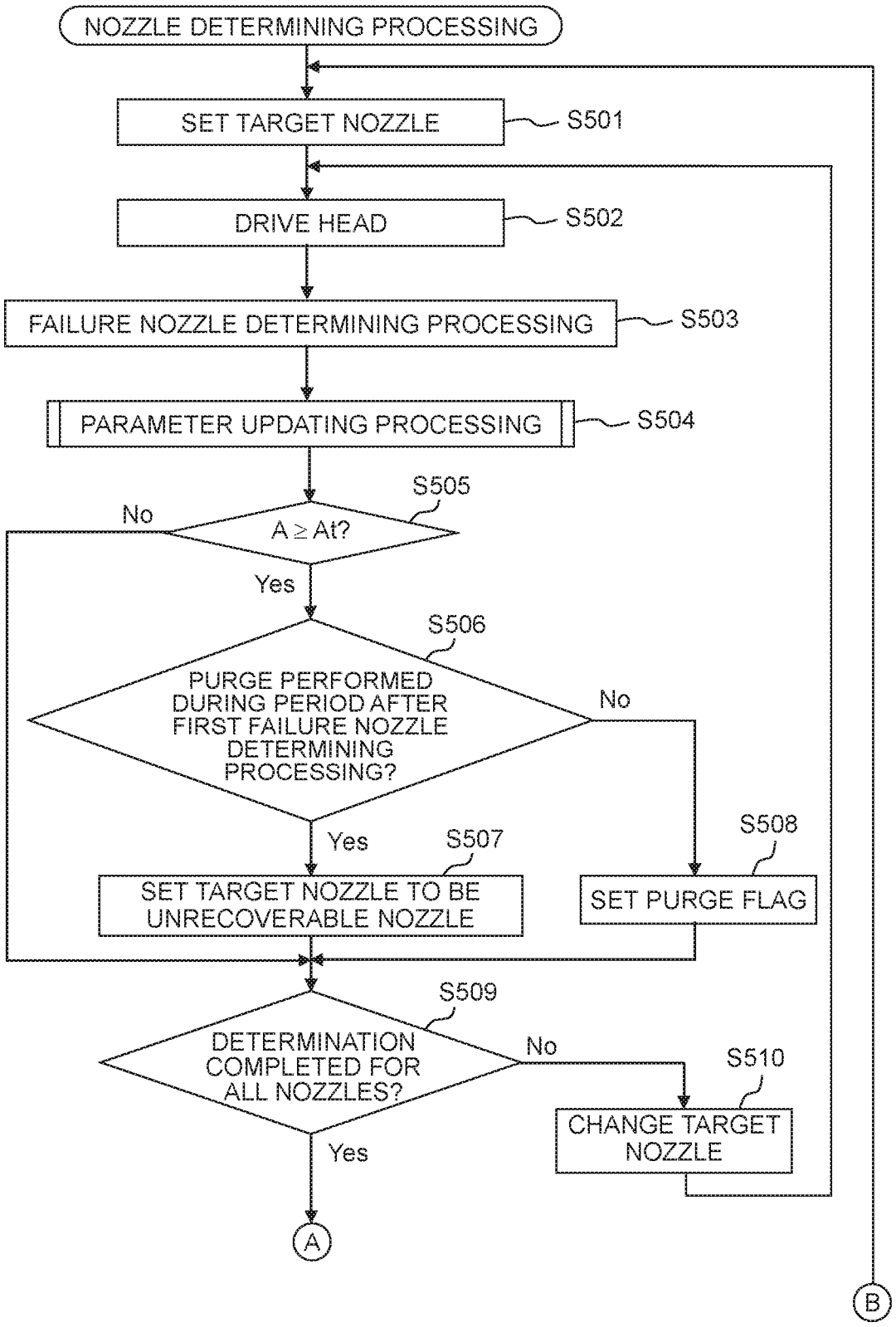
FIGS. 12A and 12B are a flow chart of the first modification, corresponding to FIG. 8.
Figures 12B, 12C:
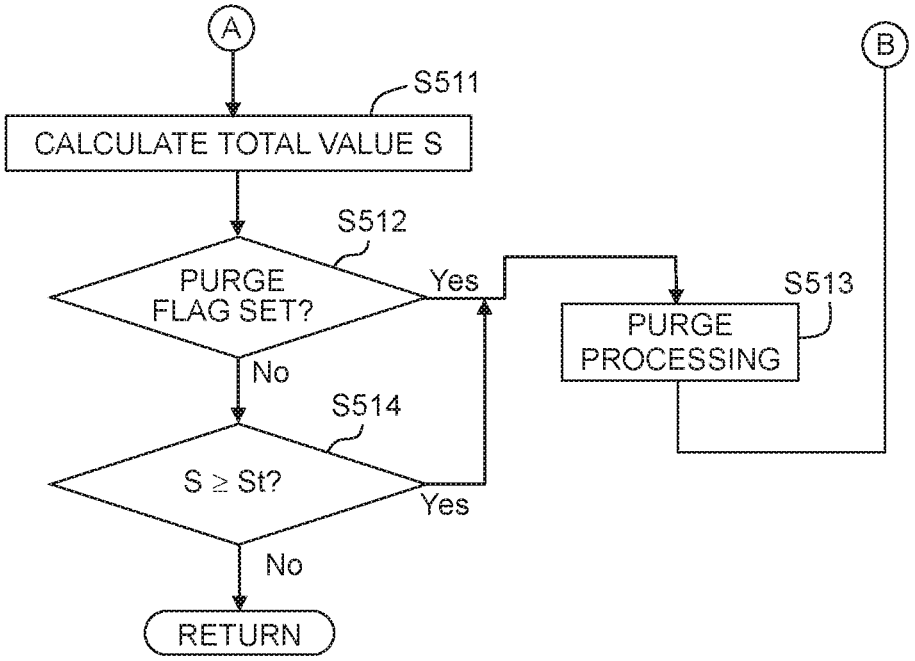
FIG. 12C is an explanatory view of a table in which values of an failure parameter and coefficients are associated with each other.

In a first modification, in a case that recording of an image onto a recording sheet P is to be performed, the controller 80 firstly performs a nozzle determining processing (step S401), as depicted in FIG. 11. In the nozzle determining processing in step S401, the controller 80 executes the processing in accordance with a flow depicted in FIGS. 12A and 12B. Processings in steps S501 to S510 in FIG. 12A are similar to those in step S201 to S210 of the above-described embodiment. Further, in the first modification, in a case that the controller 80 completes the determination as to whether or not the nozzle is a failure nozzle (failure nozzle determination) regarding all the nozzles 10 (step S509: YES), the controller 80 calculates a total sum S (step S511), as depicted in FIG. 12B.

The total value S is a total of values which are obtained by multiplying the value of the failure parameter A regarding each of the nozzles 10 having the value of the failure parameter A which is less than the threshold value At (failure nozzles which are not the unrecoverable nozzles) by a coefficient K ($K_1$, $K_2$, . . . $K_{At-2}$, $K_{At-1}$) corresponding to the value of the failure parameter A, as depicted in FIG. 12C. Here, the coefficients $K_1$, $K_2$, . . . $K_{At-2}$, $K_{At-1}$ each have a value which is less than 1, and are in a magnitude relationship of $K_1<K_2$, <. . . <$K_{At-2}$, <$K_{At-1}$. Namely, the total value S is a total value obtained by totaling values of the failure parameter A regarding the nozzles 10 each having the value of the failure parameter A which is less than the threshold value At, while weighting more greatly as each of the values of the failure parameter A of the nozzles 10 is greater.

Next, in a case that the purge flag is set (step S512: YES), the controller 80 performs the purge processing (step S513) and then returns to step S501. Further, also in a case that the purge flag is not set (step S512: NO), but that the total value S is not less than a predetermined value St (step S514: YES), the controller 80 performs the purge processing (step S513) and then returns to step S501.

In contrast, in a case that the purge flag is not set (step S512: NO) and that the total value S is less than the predetermined value St (step S514: NO), the controller 80 returns to the flow of FIG. 11, without doing any processing.

Returning to FIG. 11, after the nozzle determining processing of step S401, the controller 80 executes processings of steps S402 to S405 similar to steps S102 to S105 of the above-described embodiment. Further, in a case that the number N1 of the failure nozzle is same as the number N2 of the unrecoverable nozzle (step S405: NO), the controller 80 executes a recording processing which is similar to that in step S113 (step S409), without performing the suction purge (without executing a purge processing in step S408), in a similar manner as in the above-described embodiment.

On the other hand, in a case that the number N1 of the failure nozzle is greater than the number N2 of the unrecoverable nozzle (step S405: YES), the controller 80 then performs determination as to whether or not a value [N1−N2−S] obtained by deducting the number N2 of the unrecoverable nozzle and the total number S from the number N1 of the failure nozzle is less than a predetermined value Nt (value obtained by deducting the total number S from the number of the failure nozzle which is not the unrecoverable nozzle [N1−N2])(step S406). Note that in the first modification, the condition that [N1−N2−S] is less than the predetermined value Nt corresponds to the "purge skip condition" of the present disclosure.

Then, in a case that [N1−N2−S] is less than the predetermined value Nt (step S406: YES) and that the recording is to be performed in the normal image quality mode (step S407: Normal image quality mode), the controller 80 executes the recording processing (step S409), without performing the suction purge (without executing the purge processing in step S408).

On the other hand, in a case that [N1−N2−S] is not less than the predetermined value Nt (step S406: NO), then the controller 80 executes a purge processing similar to that in step S108 of the above-described embodiment (step S408), an then performs the recording processing (step S409). Further, even in a case that [N1−N2−S] is less than the predetermined value Nt (step S406: NO), but that the recording is to be performed in the high image quality mode (step S407: High image quality mode), then the controller 80 executes the purge processing (step S408), and then executes the recording processing (step S409).

A nozzle 10 which is recoverable by the suction purge is usually recovers once the suction purge is performed therefor. Accordingly, as the number of times the nozzle 10 is continuously determined to be the failure nozzle is greater, a possibility that the nozzle 10 is the unrecoverable nozzle becomes to be quite high. Therefore, among failure nozzles each of which is not set to be the unrecoverable nozzle (nozzles each having the value of the failure parameter A which is less than the threshold value At), there is a high possibility that any failure nozzle of which value of the failure parameter A is large might be the unrecoverable nozzle (might be set as the unrecoverable nozzle in the future). As a result, in a case that the purge skip condition is simply made to a condition regarding the number of the failure nozzles each of which is not set to be the unrecoverable nozzle, there is such a fear that the suction purge might be performed even in such a case that the number of the failure nozzles each of which is highly likely to be set as the unrecoverable nozzle in the future is great and that the number of the failure nozzles each of which is recoverable is small, and that the ink might be discharged wastefully.

In view of the above-described situation, the first modification calculates the total value S which is obtained by totaling values of the failure parameter A regarding the failure nozzles 10 each of which is not set as the unrecoverable nozzle, while weighting more greatly as each of the values of the failure parameter of the failure nozzles is greater. Then, the condition that the value obtained by deducting the total value S from the number of the failure nozzles each of which is not set as the unrecoverable nozzle [N1−N2−S] is less than the predetermined value Nt is made to be the purge skip condition. By doing so, is it possible to prevent such a situation that the suction purge might be performed even in such a case that the number of the failure nozzles each of which might be set as the unrecoverable nozzle in the future is great and that the number of the failure nozzles each of which is recoverable is small, and that the ink might be discharged wastefully.

Also in the first modification, in a case that the purge skip condition is satisfied and that the recording is to be performed in the normal image quality mode, the recording of an image is performed, without performing the suction purge. By doing so, it is possible to shorten the time since the recording instruction is inputted and until the recording of the image onto the recording medium is completed.

On the other hand, in a case that the purge skip condition is not satisfied, the suction purge is performed so as to recover a failure nozzle which is not the unrecoverable nozzle, and then the recording of the mage is performed.

Further, even in a case that the purge skip condition is satisfied, but that the recording is to be performed in the high quality image mode, the suction purge is performed so as to recover the failure nozzle which is not the unrecoverable nozzle, and then the recording of the mage is performed. By doing so, it is possible to prevent such a situation that the quality of the image which is recorded is greatly lowered.

Further, as described above, in a case that there is a large number of the failure nozzles which are not set as the unrecoverable nozzle but each of which has a great value of the failure parameter, then there is a high possibility that there might be a large number of failure nozzles set as the unrecoverable nozzles in the future. Furthermore, in such a case, it is preferred that the failure nozzles which would be set as the unrecoverable nozzles are set to be the unrecoverable nozzles, as soon as possible.

Accordingly, in the first modification, in the case that the total value S is not less than the predetermined value St, the suction purge is performed, then the failure nozzle determination is performed, and then the value of the failure parameter A is updated. By doing so, the value of the failure parameter of a failure nozzle which is not recovered by the suction purge is increased. As a result, in a case that the failure nozzle of which value of the failure parameter A is less than the threshold value A is the unrecoverable nozzle, it is possible to fasten the time until the value of the failure parameter A of such a failure nozzle becomes to be not less than the threshold value A and to be set as the unrecoverable nozzle.

Figure 13A:
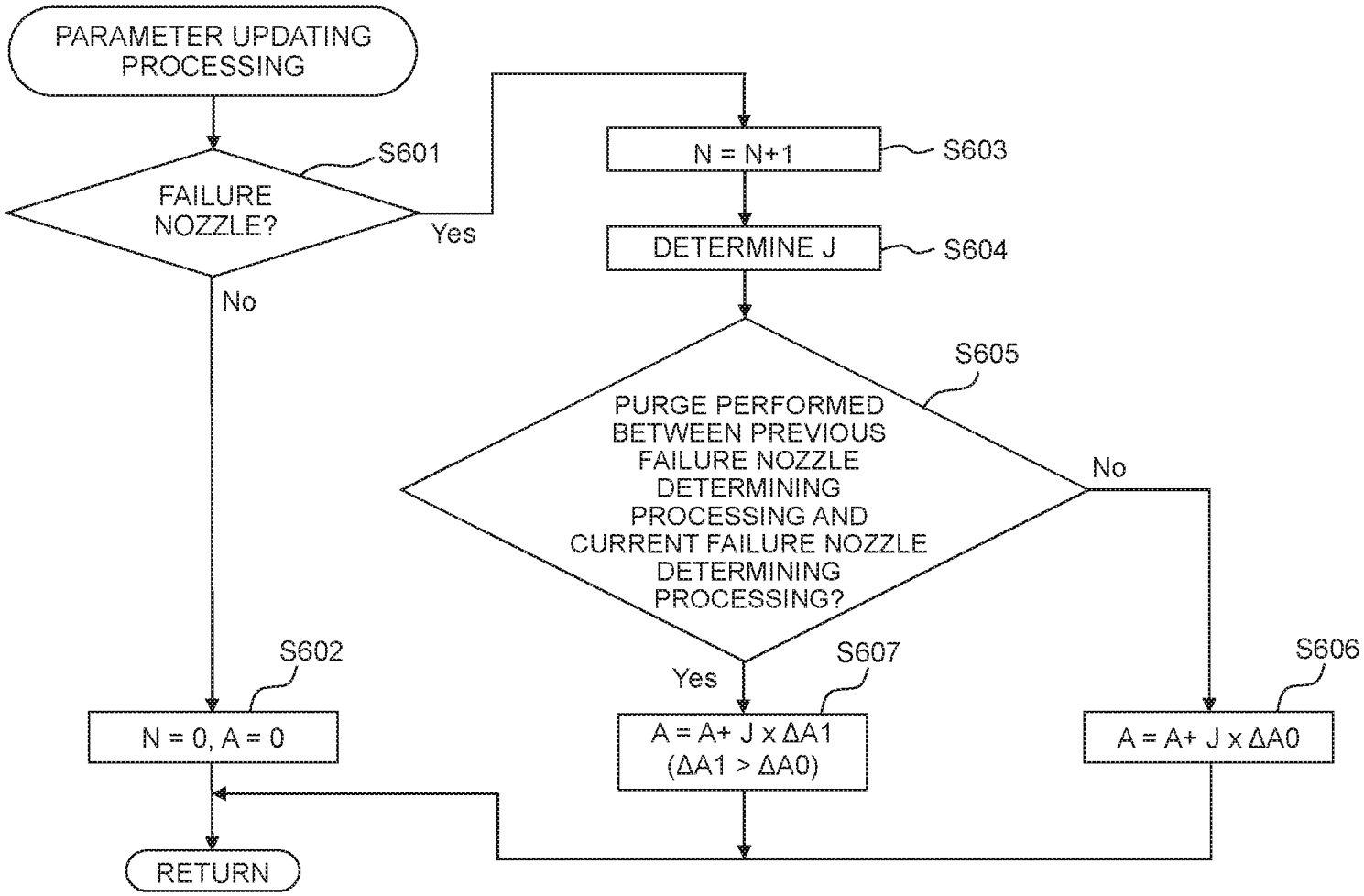
FIG. 13A is a flow chart of a second modification, corresponding to FIG. 9.

In a second modification, in a case that the controller 80 performs recording of an image on a recording sheet P, the controller 80 performs the processing in accordance with the flow in FIG. 11, similarly to the first modification. Further, the controller 80 performs the processing in the nozzle determining processing in step S401 in accordance with the flow in FIG. 12A. Note, however, that in the second modification, the controller 80 performs the processing in a parameter updating processing in step S504 in accordance with a flow in FIG. 13A.

To provide a more specific explanation, in the parameter updating processing in the second modification, in a case that the controller 80 determines in a failure nozzle determining processing in step S503 that a certain nozzle 10 is not the failure nozzle (step S601: NO), the controller 80 sets the value of the failure parameter A of the certain nozzle 10 to be "0" (zero) and sets a number of times of continuous determination N to be "0" (zero) (step S602). The number of times of continuous determination N is a number of times a same nozzle 10 is continuously determined to be the failure nozzle. Further, the continuous determination number of times N is set, for example, to be 0 (zero) at the production time of the printer, etc.

On the other hand, in a case that the controller 80 determines in the failure nozzle determination in step S503 that the certain nozzle 10 is the failure nozzle (step S601: YES), the controller 80 sets the value of the number of times of continuous determination of the certain nozzle 10 to be [N+1] (step S603), and determines the value of a coefficient J (step S604). In step S604, the controller 80 determines the value of the coefficient J to be any one of $J_1$, $J_2$, . . . $J_{Nm-1}$, $J_{Nm}$, based on a current number of times of continuous determination N (1, 2, . . . Nm−1, Nm). Here, $J_1$, $J_2$, . . . $J_{Nm-1}$, $J_{Nm}$ are in a magnitude relationship of $J_1<J_2<J_{Nm-1}<J_{Nm}$. Namely, as the current number of times of continuous determination N is greater, the value of the coefficient J is greater. Further note that "Nm" is a minimum number of times of continuous determination N by which the value of the failure parameter A becomes to be not less than the threshold value At in a case that the value of the parameter A is updated in accordance with the flow of FIG. 13A.

Furthermore, in a case that the suction purge has been not performed, with respect to the certain nozzle 10 determined to be the failure nozzle in step S503, during a period since the failure nozzle determination performed previously and until the failure nozzle determination performed currently (step S605: NO), the controller 80 updates the value of the failure parameter A to be [A+J×ΔA0] (step S606). On the other hand, in a case that the suction purge has been performed, with respect to the certain nozzle 10 determined to be the failure nozzle in step S503, during the period since the failure nozzle determination performed previously and until the failure nozzle determination performed currently (step S605: YES), the controller 80 updates the value of the failure parameter A to be [A+J×ΔA1] (ΔA1>ΔA0) (step S607).

Then in the case of the second modification, the controller 80 calculates, in step S511, a value obtained by totaling the values of the failure parameters A regarding nozzles 10 in each of which the value of the failure parameter is less than the threshold value At (nozzles which are not the unrecoverable nozzles), as the total value S.

In the second modification, as the number of times of continuous determination N which is a number of times by which a same nozzle 10 is continuously determined to be the failure nozzle is increased, the value of the failure parameter A is increased more greatly. Then, the controller 80 calculates the total value S obtained by totaling the values of the failure parameter A of the failure nozzles 10 each of which is not set to be the unrecoverable nozzle.

Then, in a similar manner as that explained regarding the first modification, the condition that the number [N1−N2−S] obtained by deducting the total value from the number of the failure nozzles each of which is not set to be the unrecoverable nozzle is less than the threshold value Nt is made to be the purge skip condition. By doing so, is it possible to prevent such a situation that the suction purge might be performed even in such a case that the number of the failure nozzles each of which might be set as the unrecoverable nozzle in the future is great and that the number of the failure nozzles which are unrecoverable is small, and that the liquid (ink) might be discharged wastefully.

Also in the second modification, in a case that the above-described purge skip condition is satisfied and that the recording is to be performed in the normal image quality mode, the second modification performs the recording of an image, without performing the suction purge. By doing so, it is possible to shorten the time since the recording instruction is inputted and until the recording of an image onto the recording medium is completed.

On the other hand, in a case that the purge skip condition is not satisfied, the suction purge is performed so as to recover a failure nozzle which is not the unrecoverable nozzle, and then to perform the recording of the image. Further, in a case that even if the purge skip condition is satisfied, but that the recording is to be performed in the high quality image mode, then the suction purge is performed so as to recover a failure nozzle which is not the unrecoverable nozzle, and then to perform the recording of the image. By doing so, it is possible to prevent the image quality of the image which is recorded from lowering greatly.

Further, also in the second modification, in the case that the total value S is not less than the predetermined value St, the suction purge is performed, then the failure nozzle determination is performed, and then the value of the failure parameter A is updated, based on the result of the failure nozzle determination. By doing so, the value of the failure parameter A of a failure nozzle which is not recovered by the suction purge is increased. As a result, in a case that the failure nozzle of which value of the failure parameter A is less than the threshold value A is the unrecoverable nozzle, it is possible to fasten the time until the value of the failure parameter A of such a failure nozzle becomes to be not less than the threshold value A and to be set as the unrecoverable nozzle.

Furthermore, in the first and second modifications, the determination as to whether or not the purge processing in step S408 is to be performed and the determination as to whether or not the purge processing in step S513 is to be performed are executed based on the total value S. The present disclosure, however, is not limited to or restricted by this. For example, it is allowable that the determination as to whether or not the purge processing in step S408 is to be performed is executed based on the total value S in a similar manner as in the first and second modifications, and that the determination as to whether or not the purge processing in step S212 is to be performed is executed based on whether or not the purge flag is set, regardless of the total value S, in a similar manner in the above-described embodiment. Alternatively, it is allowable that the determination as to whether or not the purge processing in step S513 is to be performed is executed based on the total value S in a similar manner as in the first and second modifications, and that the determination as to whether or not the purge processing in step S112 is to be performed is executed based only on the number of the failure nozzles which are not the unrecoverable nozzles [N1−N2], regardless of the total value S, in a similar manner in the above-described embodiment.

Moreover, the purge skip condition is not limited to those explained in the above-described embodiment, first modification and second modification. The purge skip condition may be another condition regarding the number of the failure nozzles each of which is not the unrecoverable nozzle, or may be another condition regarding the value obtained by deducting the total number S from the number of the failure nozzles each of which is not the unrecoverable nozzle. Further, the purge skip condition may be a condition which does not relate to (is not associated with) either one of the number of the failure nozzles each of which is not the unrecoverable nozzle, and the value obtained by deducting the total number S from the number of the failure nozzles each of which is not the unrecoverable nozzle.

Further, in the above-described example, the recording of the image on the recording sheet P is performed, without performing the suction purge, in a case that in the printer, the recording of image on the recording sheet P is possible in either one of the normal image quality mode and the high image quality mode, and that the purge skip condition is satisfied and the recording is performed in the normal image quality mode. On the other hand, the suction purge is performed and then the recording of the image on the recording sheet P is performed, in a case that the purge skip condition is satisfied but that recording is to be performed in the high image quality mode. The present disclosure, however, is not limited to this.

For example, in a case that the purge skip condition is satisfied, it is allowable to perform the recording of image onto the recording sheet P, without performing the suction purge, regardless of the high image quality mode or the normal image quality mode. Alternatively, in a case that the printer is capable of performing the recording of image only in one kind of recording mode, it is allowable that the recording of image onto the recording sheet P is performed, without performing the suction purge, in a case that the purge skip condition is satisfied.

Further, in the above-described example, in the case that the number N1 of the unrecoverable nozzle is less than the predetermined number Ns and that a failure nozzle which is not the unrecoverable nozzle is present (in a case of N1>N2), the determination as to whether or not the suction purge is to be performed before performing the recording of image onto the recording sheet P is performed based at least on the result of the determination as to whether or not the purge skip condition is satisfied. The present disclosure, however, is not limited to this. For example, in a case that any failure nozzle which is not the unrecoverable nozzle is present (in the case of N1>N2), it is allowable to perform the recording of image onto the recording sheet P always after performing the suction purge.

Further, in the above-described embodiment, the displaying section 70 is caused to display the message, etc., so as to notify the user of the presence of the unrecoverable nozzle. The present disclosure, however, is not limited to this. For example, it is allowable that the printer has a speaker, etc., and it is allowable, in the notifying processing, to notify the user of the presence of the unrecoverable nozzle by another method such as, for example, by sounding an alarm notifying the user of the presence of the unrecoverable nozzle.

Further, in the above-described embodiment, the notifying processing and the interpolating setting are performed in the case that the unrecoverable nozzle is present. The present disclosure, however, is not limited to this. For example, in the case that the unrecoverable nozzle is present, it is allowable to perform the interpolating setting, without performing the notifying processing. Alternatively, it is allowable to notify the user of the presence of the unrecoverable nozzle (to notify the user that the ink-jet head 4 is broken), and to stop the recording of image. Still alternatively, in the case that the unrecoverable nozzle is present, it is possible to stop the recording of image without performing the notification to the user.

Further, in the above-described embodiment, in a case that a certain nozzle 10 is determined to be the failure nozzle, an increasing amount by which the value of the failure parameter is increased is made different depending on whether or not the suction purge is performed since the certain nozzle 10 has been determined to be the failure nozzle previously and until the certain nozzle 10 is determined to be the failure nozzle currently. The present disclosure, however, is not limited to this.

For example, in a third modification, the printer 1 is capable of selectively performing a first suction purge (corresponding to a "first purge" of the present disclosure) and a second suction purge (corresponding to a "second purge" of the present disclosure) in which a discharge amount of the ink is greater than that in the first suction purge. Note that in the third modification, either one of the first suction purge and the second suction purge is performed in the purge processings in steps S108 and S212 of the above-described embodiment. It is allowable to determine in advance as to which one of the first and second suction purges is to be performed; or it is allowable to switch between performing the first suction purge and performing the second suction purge, depending on a various kinds of conditions.

Figure 14:
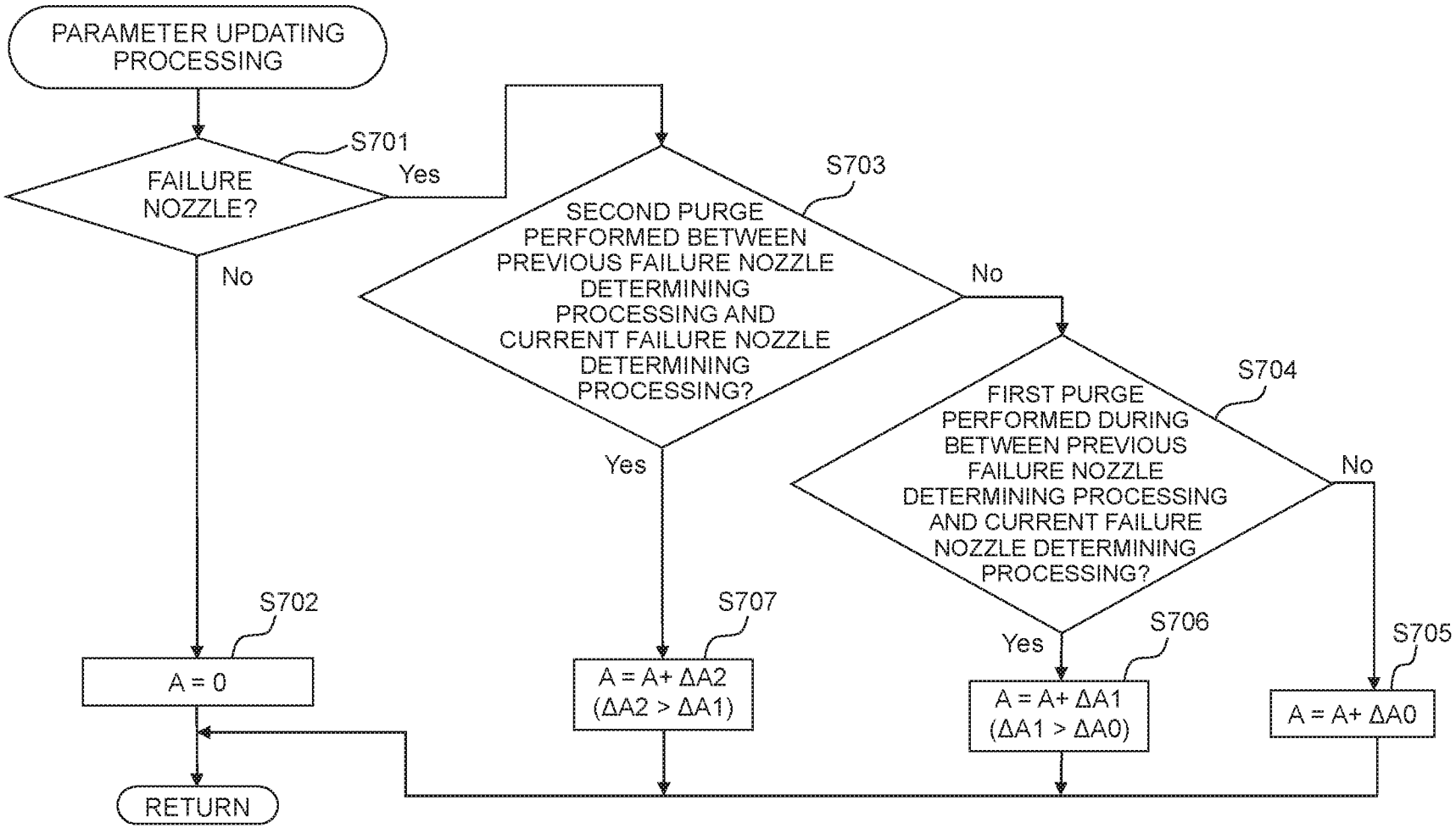
FIG. 14 is a flow chart of a third modification, corresponding to FIG. 9.

Further, in the parameter updating processing of the third modification, as depicted in FIG. 14, in a case that a certain nozzle 10 is not the failure nozzle (step S701: NO), the controller 80 sets the value of the failure parameter A to be 0 (zero) (step S702).

On the other hand, in a case that the certain nozzle 10 is the failure nozzle (step S701: YES), and that any of the first suction purge and the second suction purge has not been performed during a period since the certain nozzle 10 has been determined as the failure nozzle previously and until the certain nozzle 10 is determined to be the failure nozzle currently (step S703: NO, step S704: NO), the controller 80 sets the value of the failure parameter A to be [A+ΔA0] (step S705).

On the other hand, in a case that the certain nozzle 10 is the failure nozzle (step S701: YES), and that the second suction purge has not been performed (step S703: NO) and that the first suction purge has been performed (step S704: YES) during the above-described period, the controller 80 sets the value of the failure parameter A to be [A+ΔA1] (ΔA1>ΔA0) (step S706).

On the other hand, in a case that the certain nozzle 10 is the failure nozzle (step S701: YES), and that the second suction purge has been performed (S703: YES) during the above-described period, the controller 80 sets the value of the failure parameter A to be [A+ΔA2] (ΔA2>ΔA1) (step S707).

In a case that the suction purge has been performed during the period since the failure nozzle determination performed previously for a certain nozzle 10 until the failure nozzle determination performed currently for the certain nozzle 10, there is a high possibility that the certain nozzle 10 determined to be the failure nozzle might be the unrecoverable nozzle, as compared with a case that any suction purge has not been performed. Further, in a case that the suction purge has been performed during the above-described period and that the suction purge performed is the second suction purge in which the discharge amount is great, there is a higher possibility that the certain nozzle 10 determined to be the failure nozzle might be the unrecoverable nozzle, as compared with a case that the first suction purge in which the discharge amount is small has been performed during the above-described period. Accordingly, in the case that the second suction purge has been performed during the above-described period, the value of the failure parameter A is increased greatly than that in the case that the first suction purge has been performed during the above-described period.

Alternatively, in a case that a certain nozzle 10 is the failure nozzle, it is allowable in the parameter updating processing to increase the value of the failure parameter A uniformly, regardless as to whether or not the suction purge has been performed during the period since the failure nozzle determination performed previously for the certain nozzle 10 until the failure nozzle determination performed currently for the certain nozzle 10.

Figure 15:
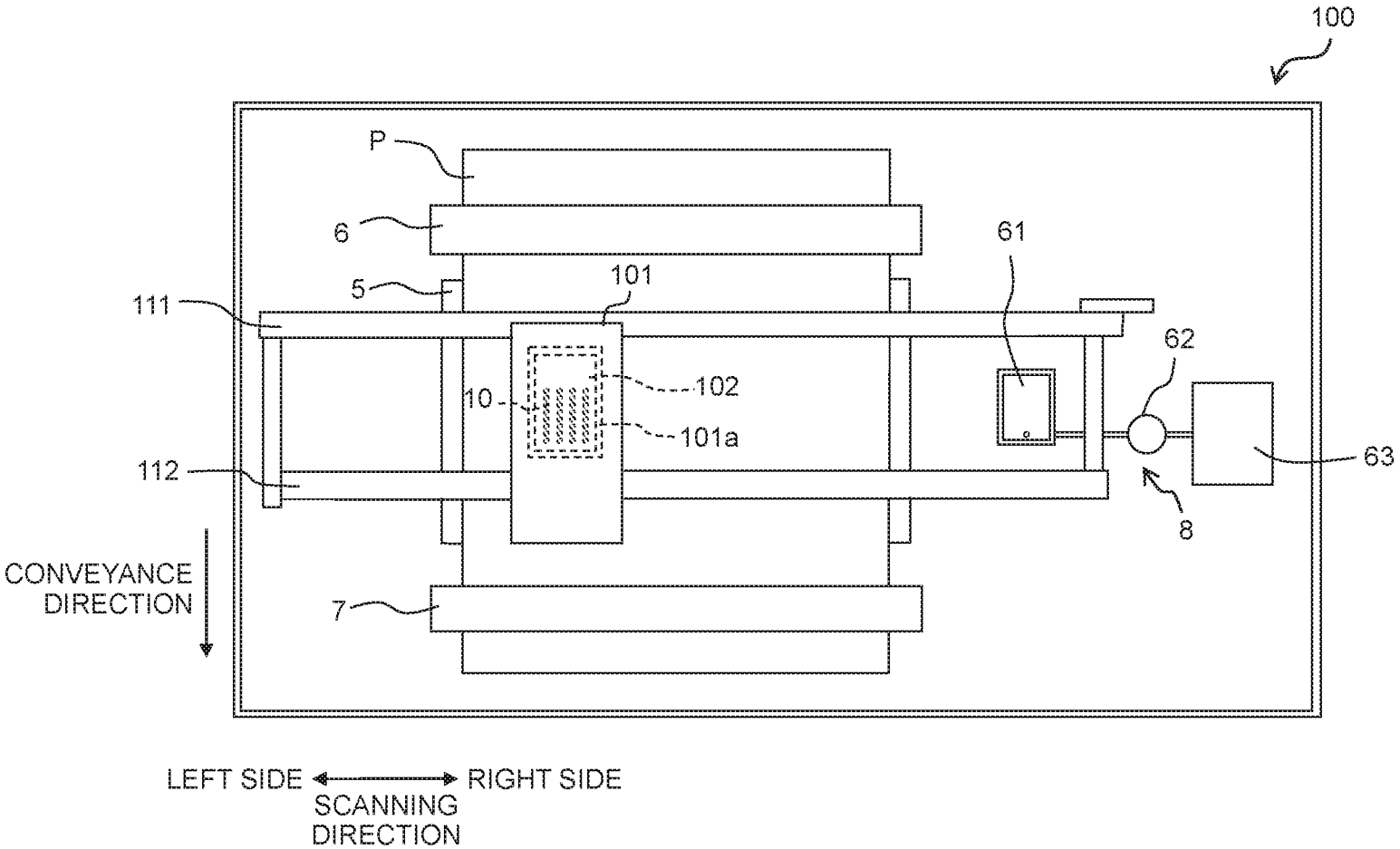
FIG. 15 is a view of a fourth modification, corresponding to FIG. 1.

Further, it is also possible to apply the present disclosure to a printer in which an ink-jet head can be exchanged (replaced) by a user. For example, in a fourth modification, a printer 100 is provided with a carriage 101, and an ink-jet head 102 (corresponding to a "liquid discharging head" of the present disclosure), as depicted in FIG. 15. Further, in addition to the carriage 101 and the ink-jet head 102, the printer 100 is also provided with a platen 5, conveying rollers 6 and 7, a maintenance unit 8, etc., similarly to the printer 1.

Similarly to the carriage 2 of the above-described embodiment, the carriage 101 moves in the scanning direction along the guide rails 11 and 12. Further, the carriage 101 is provided with a head installing part 101*a*. The ink-jet head 102 is detachably installed in the head installing part 101*a*. With this, in the fourth modification, the user can exchange the ink-jet head 102.

Similarly to the ink-jet head 4 of the above-described embodiment, the ink-jet head 102 has a plurality of nozzles 10. Further, unlike the configuration in the above-described embodiment that the inks are supplied to the ink-jet head 4 from the ink cartridges 15 via the sub tank 3, the fourth modification has a configuration that the ink-jet head 4 is integrally formed with an ink cartridge storing an ink(s) therein.

Note that although the fourth modification is exemplified by a configuration wherein one ink-jet head 102 is detachably installed in the head installing part 101*a*, the present disclosure is not limited to this. For example, it is allowable that separate (individual) ink-jet heads for colors of inks to be discharged, respectively, are detachably installed in a head installing part of the carriage 101, and that each of the ink-jet heads is independently or separately exchangeable (replaceable).

Figure 16:
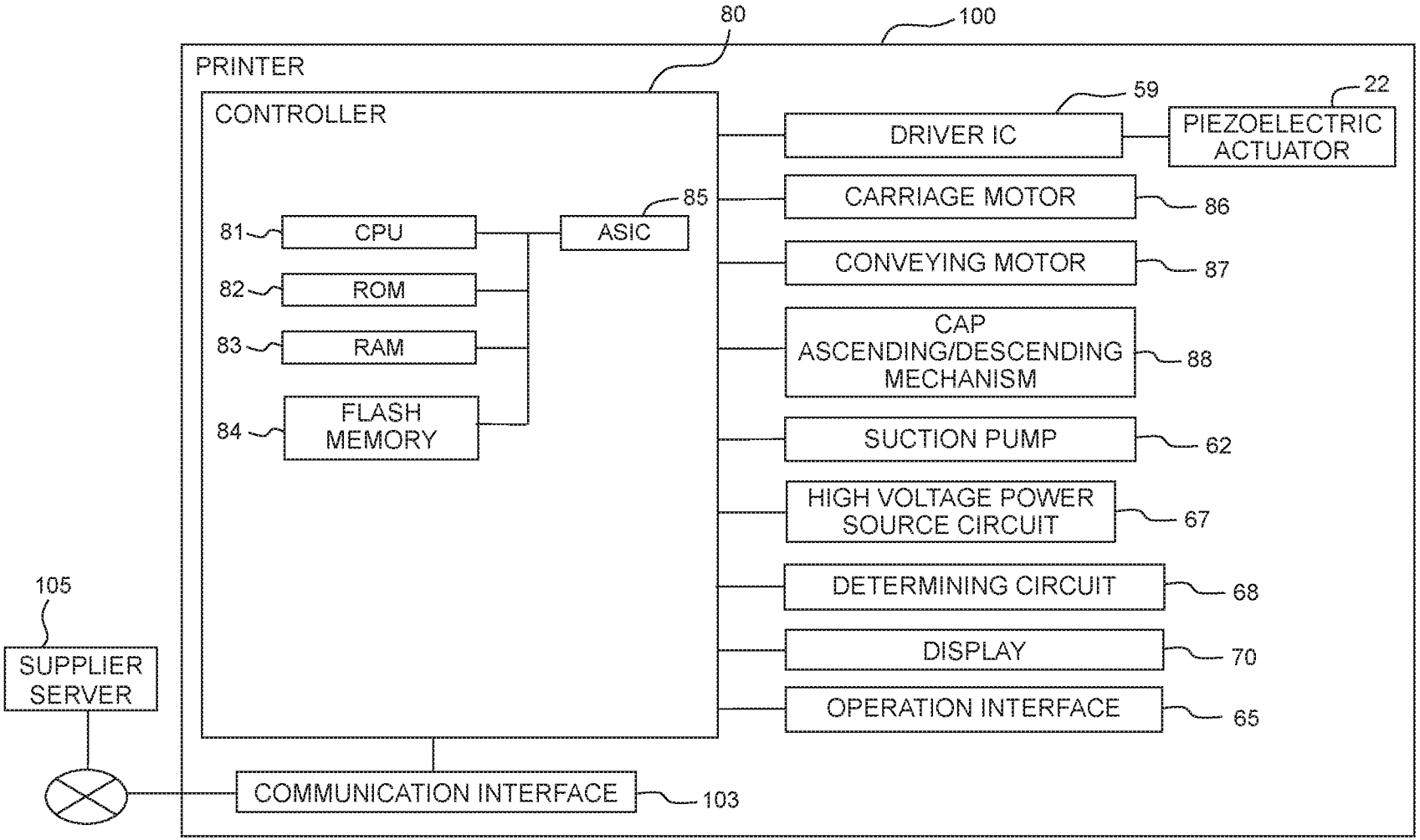
FIG. 16 is a view of the fourth modification, corresponding to FIG. 6.

Further, as depicted in FIG. 16, the printer 100 is provided with a communication interface 103 connected to the controller 80. The communication interface 103 is connected to a network 104 such as the Internet. Furthermore, a supplier server 105 which receives an order of the ink-jet head 102 is also connected to the network 104. With this, the controller 80 is connected to the supplier server 105 via the communication interface 103 and the network 104.

Figure 17:
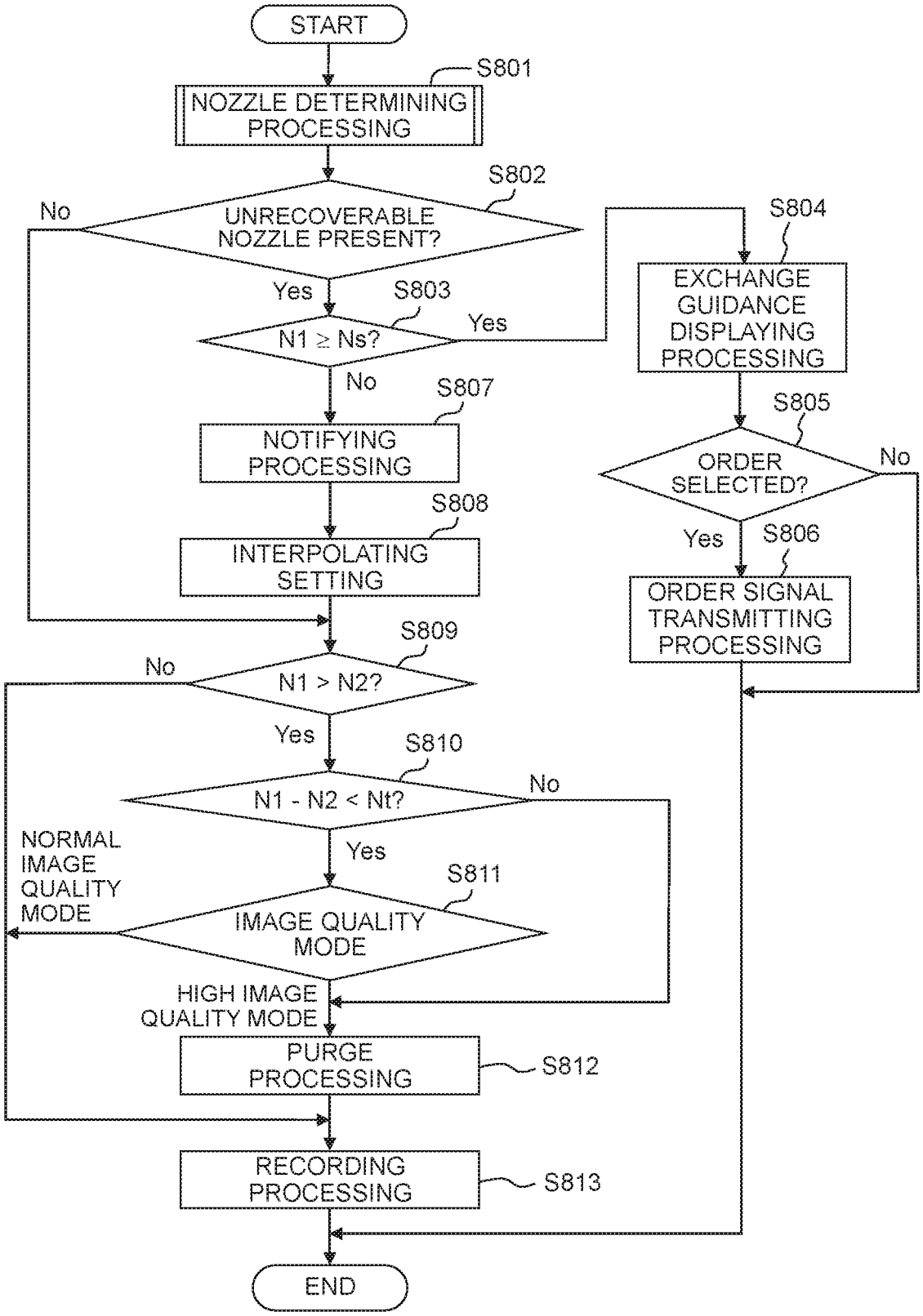
FIG. 17 is a flow chart of the fourth modification, corresponding to FIG. 7.

Further, in the fourth modification, in a case that recording of an image onto the recording sheet P is to be performed, the controller 80 performs the processing in accordance with a flow in FIG. 17. To provide more specific explanation, the controller 80 executes a nozzle determining processing (step S801) which is similar to the step S101 of the above-described embodiment, and then the controller 80 determines as to whether or not any unrecoverable nozzle is present among the plurality of nozzles 10 of the ink-jet head 102 (step S802).

In a case that any unrecoverable nozzle is not present among the plurality of nozzles 10 in the ink-jet head 102 (step S802: NO), the controller 80 proceeds to step S809. On the other hand, in a case that a unrecoverable nozzle is present among the plurality of nozzles 10 in the ink-jet head 102 (step S802: YES), the controller 80 then determines as to whether or not the number N1 of the unrecoverable nozzle is not less than a predetermined number Ns (step S803). Here, the predetermined number Ns may be a fixed number which is determined previously, or may be a number which is changeable by setting performed by the user.

In a case that the number N1 of the unrecoverable nozzle is not less than the predetermined number Ns (step S803: YES), the controller 80 then executes an exchange guidance displaying processing of causing the displaying part 70 to display a message urging the exchange of the ink-jet head 102 (corresponding to a "guidance urging exchange of the liquid discharging head" of the present disclosure) and a screen for selection as to whether or not a new ink-jet head 102 is to be ordered (step S804). Further, in a case that a signal instructing that the ink-jet head 102 is to be ordered is inputted from the operation interface 65 by an operation by the user to the controller 80 (step S805: YES), the controller 80 executes an order signal transmitting processing of transmitting an order signal for ordering the ink-jet head 102 to the supplier server 105 via the communication interface 103 and the network 104 (step S806), and then ends the processing.

On the other hand, in a case that the signal instructing that the ink-jet head 102 is to be ordered is not inputted to the controller 80 (step S805: NO), the controller 80 ends the processing, without doing any processing. Here, the case that the signal instructing that the ink-jet head 102 is to be ordered is not inputted to the controller 80 is, for example, such a case that a signal instructing that the ink-jet head 102 is not to be ordered is inputted to the controller 80 from the operation interface 65 by an operation by the user, a case that a predetermined time is elapsed since the execution of the exchange guidance displaying processing of step S804, without any signal, indicating whether the ink-jet head 102 is to be ordered or not, being inputted to the controller 80, etc.

In a case that that the number N1 of the unrecoverable nozzle is less than the predetermined number Ns (step S803: NO), the controller 80 executes a notifying processing (step S807) similar to that in step S103 of the above-described embodiment, and an interpolating setting (step S808) similar to that in step S104 of the above-described embodiment, and proceeds to step S809. The processings in step S809 to S813 are similar to those in steps S105 to S109 of the above-described embodiment.

In the fourth modification, in the case that the number N1 of the unrecoverable nozzle is not less than the predetermined number Ns, the displaying part 70 is caused to display the guidance for urging the exchange of the ink-jet head 102. With this, in a case that the number of the unrecoverable nozzle becomes to be great, it is possible to urge the user to exchange the ink-jet head 102.

Further, in the fourth modification, in the case that the number N1 of the unrecoverable nozzle is not less than the predetermined number Ns, an order placement signal for ordering the ink-jet head 102 is transmitted, to the supplier server 105, in accordance with the instruction from the user (operation of the operation interface 65 by the user). With this, in the case that the number of the unrecoverable nozzle becomes to be great, the order of the ink-jet head 102 is performed with respect to the order placement source. Furthermore, this makes it possible for the user to exchange the ink-jet head 102 attached to the head installing part 101*a* for an ink-jet head 102 delivered from the order placement source.

Furthermore, in the fourth modification, in the case that the number N1 of the unrecoverable nozzle is not less than the predetermined number Ns, the controller 80 causes the displaying part 70 to display the screen for selection as to whether or not a new ink-jet head 102 is to be ordered, together with the message urging the exchange of the ink-jet head 102. Moreover, in the case that the signal instructing that the ink-jet head 102 is to be ordered is inputted to the controller 80, the controller 80 transmits the order placement signal for ordering the ink-jet head 102 to the supplier server 105. The present disclosure, however, is not limited to this.

For example, in the case that the number N1 of the unrecoverable nozzle is not less than the predetermined number Ns, it is allowable that, for example, the controller 80 causes the displaying part 70 to display the message urging the exchange of the ink-jet head 102, and a message that an order of the ink-jet head 102 has been placed, and that the controller 80 automatically transmits the above-described order placement signal to the supplier server 105.

Alternatively, in a case that the printer 1 does not have the function of transmitting the above-described order placement signal to the order-placement source server, it is allowable that, in the case that the number N1 of the unrecoverable nozzle is not less than the predetermined number Ns, the controller 80 only causes the displaying part 70 to display the message urging the exchange of the ink-jet head 102.

Still alternatively, it is also allowable that a light emitting body such as a LED lamp, etc., is provided as the displaying part, rather than causing the displaying part 70 such as the display to display a message, and that the light emitting body is caused to emit light so as to urge the user to exchange the ink-jet head 102. Note that is this case, the light emission performed by the light emitting body corresponds to the "guidance urging exchange of the liquid discharging head" of the present disclosure.

Moreover, in the above-described embodiment, although the ink(s) inside the ink-jet head 4 is (are) discharged (exhausted) from the nozzles 10 by the suction purge, the present disclosure is not limited to this configuration. For example, it is allowable to provide a pressure pump at an intermediate part of the tubes 13 connecting the sub tank 3 to the ink cartridges 15. Alternatively, it is allowable that the printer is provided with a pressure pump which is connected to the ink cartridges. Further, it is allowable to drive the pressure pump in a state that the plurality of nozzles 10 are covered by the cap 61 to thereby perform a so-called pressure purge of pressurizing the ink inside the ink-jet head 4 and of discharging the ink inside the ink-jet head 4 from the nozzles 10. Note that in this case, the cap 61 and the pressure pump are combined so as to collectively correspond to a "purge mechanism" of the present disclosure.

Further, in the purge, it is allowable to perform both of the suction by the suction pump 62 and the pressurization by the pressure pump. In this case, the maintenance unit 8 and the pressure pump are combined so as to collectively correspond to the "purge mechanism" of the present disclosure.

Furthermore, in the above-described embodiment, although the voltage value of the detecting electrode 66 in a case that the ink is discharged from the nozzle 10 toward the detecting electrode 66 is used to thereby determine whether or not the ink is discharged from the nozzle 10, the present disclosure is not limited to this.

For example, it is allowable to arrange a detecting electrode extending in the up-down direction, and to use a voltage value of the detecting electrode in a case that the ink is discharged from the nozzle 10 so that the discharged ink passes through an area facing the detecting electrode, to thereby determine whether or not the ink is discharged from the nozzle 10. Alternatively, it is allowable to provide an optical sensor which detects the ink discharged from the nozzle 10, and to determine whether or not the ink is discharged from the nozzle 10 based on a result of detection performed by the optical sensor.

Still alternatively, it is allowable to connect a voltage detecting circuit, which detects the change in voltage in a case that the ink is discharged from the nozzle, to a plate of the ink-jet head in which the nozzles are formed, and to cause the voltage detecting circuit to output, to the controller 80, a signal depending on whether or not the nozzle 10 is the failure nozzle, in a similar manner as described in Japanese Patent No. 4,929,699.

Yet still alternatively, it is allowable that a substrate of the ink-jet head is provided with a temperature detecting element, in a similar manner as described in Japanese Patent No. 6,231,759. Further, after a first application voltage is applied to thereby drive a heater so as to discharge the ink, a second application voltage to thereby drive the heater so as not to allow the ink to be discharged, and then to determine whether or not the discharge has been performed normally based on the change in the temperature detected by the temperature detecting element during a period since the heater has been driven as described above and until a predetermined time elapses.

Further, in the above-described embodiment, the determination as to whether or not any abnormality occurs in the nozzle 10 (whether or not the nozzle 10 is the failure nozzle) is performed based on as to whether or not the ink is discharged from the nozzle. The present disclosure, however, is not limited to this. For example, it is allowable to determine whether or not the nozzle 10 is a failure nozzle which does not satisfy a predetermined discharging condition, based on whether or not a flying velocity of the ink discharged from the nozzle 10 is within a predetermined velocity range, whether or not the ink discharged from the nozzle 10 has landed at a predetermined landing position, whether or not a desired amount of the ink is discharged from the nozzle 10, etc.

Furthermore, in the nozzle determining processing performed in the above-described embodiment and in the first modification, the failure nozzle determination is performed for all the plurality of nozzles 10. It is allowable, however, that the failure nozzle determination is performed for at least a part of the plurality of nozzles 10. For example, in a case that a pigment ink and a dye ink are discharged from the ink-jet head 4, nozzles 10 which are included in the plurality of nozzles 10 and from which the pigment ink is discharged may be set as the target nozzle, and that the failure nozzle determination may be performed therefor. Alternatively, in a case that a first pigment ink and a second pigment ink are discharged from the ink-jet head 4 and that the particle diameter of pigment particles included in the first pigment ink is greater than the particle diameter of pigment particles included in the second pigment ink, nozzles 10 which are included in the plurality of nozzles 10 and from which the first pigment ink is discharged may be set as the target nozzle, and that the failure nozzle determination may be performed therefor. Still alternatively, among nozzles 10 which are included in the plurality of nozzles 10 and which construct each of the four nozzle rows 9 in the ink-jet head 4, a certain nozzle 10 which is separate or apart from the supply port 39 in the conveyance direction by not less than a predetermined distance may be set as the target nozzle, and that the failure nozzle determination may be performed therefor.

Moreover, in the above-described embodiment, the ink is discharged from the nozzle 10 by applying the pressure by the driving element 50 to the ink inside the pressure chamber 40. The present disclosure, however, is not limited to this. For example, it is allowable to heat the ink so as to generate an air bubble inside an ink channel, thereby discharging the ink from the nozzle 10.

Further, in the above-described embodiment, although the recording sheet P is conveyed by the conveying rollers 6 and 7, the present disclosure is not limited to this. For example, it is allowable to convey the recording sheet P by a conveying belt. Note that in such a case, the conveying belt corresponds to the "conveyor" of the present disclosure. Alternatively, it is allowable to provide a table which is movable for example by a ball screw, etc., and to move the table in a state that a recording medium is placed on the table, thereby conveying the recording medium. Note that in this case, the table movable by the ball screw, etc., corresponds to the "conveyor" of the present disclosure.

Furthermore, although the foregoing explanation has been given about the example wherein the present disclosure is applied to the printer which discharges the ink from the nozzles to thereby perform recording on the recording sheet P, the present disclosure is not limited to this configuration. For example, it is also possible to apply the present disclosure to a liquid discharging apparatus which is configured to discharge a liquid different from the ink, for example, a liquified resin or metal, etc.

What is claimed is:

1. A liquid discharging apparatus comprising:

a liquid discharging head having nozzles;

a purge mechanism configured to perform purge of causing liquid inside the liquid discharging head to be discharged from the nozzles;

a signal outputting circuit configured to output signals depending on whether each of the nozzles is a failure nozzle which does not satisfy a predetermined discharging performance;

a memory configured to store, with respect to each of the nozzles, a value of a failure parameter regarding a number of times each of the nozzles is continuously determined to be the failure nozzle; and a controller, wherein the controller is configured to:

perform failure nozzle determination, with respect to at least a part of the nozzles, as to whether each of the at least a part of the nozzles is the failure nozzle, based on a signal from the signal outputting circuit; and update the value of the failure parameter stored in the memory, based on a result of the failure nozzle determination, under a condition that the controller determines that the value of the failure parameter regarding a certain nozzle, included in the at least a part of the nozzles, is not less than a threshold value, in a case that the purge has been performed, with respect to the certain nozzle, during a period since the controller has determined the certain nozzle to be the failure nozzle for a first time and until the controller determines the value of the failure parameter of the certain nozzle to be not less than the threshold value, the controller is configured to set the certain nozzle to be an unrecoverable nozzle which is unrecoverable by the purge, and in a case that the purge has not been performed, with respect to the certain nozzle, during the period since the controller has determined the certain nozzle to be the failure nozzle for the first time and until the controller determines the value of the failure parameter of the certain nozzle to be not less than the threshold value, the controller is configured to: control the purge mechanism to perform the purge for the certain nozzle; perform the failure nozzle determination for the certain nozzle based on the signal from the signal outputting circuit; and update the value of the failure parameter of the certain nozzle stored in the memory, based on a result of the failure nozzle determination.

2. The liquid discharging apparatus according to claim 1, wherein the controller is configured to perform the failure nozzle determination, with respect to each of the nozzles, as to whether each of the nozzles is the failure nozzle, based on the signal from the signal outputting circuit.

3. The liquid discharging apparatus according to claim 1, wherein in a case that a liquid droplet of the liquid is discharged from one nozzle included in the nozzles, the signal outputting circuit is configured to output a signal indicating that the one nozzle is not the failure nozzle.

4. The liquid discharging apparatus according to claim 1, wherein in a case that a flying velocity of a liquid droplet of the liquid discharged from one nozzle included in the nozzles is not less than a predetermined velocity, the signal outputting circuit is configured to output a signal indicating that the one nozzle is not the failure nozzle.

5. The liquid discharging apparatus according to claim 1, wherein in a case that a flying direction of a liquid droplet of the liquid discharged from one nozzle included in the nozzles is a predetermined direction, the signal outputting circuit is configured to output a signal indicating that the one nozzle is not the failure nozzle.

6. The liquid discharging apparatus according to claim 1, wherein in a case that the purge has been performed for the certain nozzle during a period since the failure nozzle determination has been performed previously and until the failure nozzle determination is performed currently, the controller is configured to increase the value of the failure parameter of the certain nozzle to a greater extent than in a case that the purge has not been performed for the certain nozzle during the period since the failure nozzle determination has been performed previously and until the failure nozzle determination is performed currently.

7. The liquid discharging apparatus according to claim 6, wherein the controller is configured to control the purge mechanism to selectively perform either one of a first purge and a second purge in which a discharge amount of the liquid is greater than that in the first purge, and in a case that the second purge has been performed, with respect to the certain nozzle, during the period since the failure nozzle determination has been performed previously and until the failure nozzle determination is performed currently, the controller is configured to increase the value of the failure parameter of the certain nozzle to a greater extent than in a case that the first purge has been performed for the certain nozzle during the period since the failure nozzle determination has been performed previously and until the failure nozzle determination is performed currently.

8. The liquid discharging apparatus according to claim 1, further comprising:

a conveyor configured to convey a recording medium in a conveyance direction; and a carriage having the liquid discharging head mounted thereon and configured to move in a scanning direction crossing the conveyance direction, wherein the nozzles are aligned in the conveyance direction, the controller is configured to perform a recording of an image onto the recording medium by performing a recording pass of discharging the liquid from the nozzles toward the recording medium while moving the carriage in the scanning direction, and a conveying operation of conveying the recording medium by the conveyor in the conveyance direction;

in a case that the unrecoverable nozzle is present, the controller is configured to:

control the conveyor to convey the recording medium in a different conveyance amount, which is different from a conveyance amount in a case that the unrecoverable nozzle is not present, in at least a part of conveying operations executed a plurality of times during the recording of the image onto the recording medium; and control the liquid discharging head to discharge the liquid from another nozzle, which is included in the at least a part of the nozzles and which is not set to be the unrecoverable nozzle, toward a part of the recording medium corresponding to the unrecoverable nozzle, in the recording pass performed immediately after conveying the recording medium by the different conveyance amount.

9. The liquid discharging apparatus according to claim 8, wherein the controller is configured to perform the recording pass and the conveying operation alternately to thereby perform the recording of the image onto the recording medium.

10. The liquid discharging apparatus according to claim 1, further comprising a notifying part, wherein in a case that the unrecoverable nozzle is present, the controller is configured to control the notifying part to perform notification.

11. The liquid discharging apparatus according to claim 1, further comprising a display, wherein the liquid discharging head is configured to be detachably attachable to the liquid discharging apparatus, and in a case that a number of the unrecoverable nozzle is not less than a predetermined number, the controller is configured to control the display to display guidance urging exchange of the liquid discharging head.

12. The liquid discharging apparatus according to claim 1, wherein the liquid discharging head is configured to be detachably attachable to the liquid discharging apparatus, and in a case that a number of the unrecoverable nozzle is not less than a predetermined number, the controller is configured to transmit, to a predetermined supplier, an order signal for ordering the liquid discharging head.

13. The liquid discharging apparatus according to claim 1, wherein the controller is configured to perform a recording of an image onto a recording medium by causing the liquid discharging head to discharge the liquid from the nozzles toward the recording medium, the controller is configured to perform the failure nozzle determination before the recording of the image onto the recording medium, under a condition that the nozzles include a failure nozzle which is not set to be the unrecoverable nozzle, in a case that the failure nozzle which is not set to be the unrecoverable nozzle satisfies a predetermined purge skip condition, the controller is configured to perform the recording of the image, without causing the purge mechanism to perform the purge; and in a case that the failure nozzle which is not set to be the unrecoverable nozzle does not satisfy the predetermined purge skip condition, the controller is configured to perform the recording of the image, after causing the purge mechanism to perform the purge.

14. The liquid discharging apparatus according to claim 13, wherein the purge skip condition includes a condition regarding a number of the failure nozzle which is not set to be the unrecoverable nozzle.

15. The liquid discharging apparatus according to claim 14, wherein the purge skip condition is a condition that the number of the failure nozzle which is not set to be the unrecoverable nozzle is less than a predetermined nozzle number, the controller is configured to perform the recording of the image on the recording medium by either one of a first recording mode and a second recording mode of which image quality is higher than that of the first recording mode, in a case that the purge skip condition is satisfied and the controller performs the recording of the image by the first recording mode, the controller is configured to perform the recording of the image, without causing the purge mechanism to perform the purge, and in a case that the purge skip condition is satisfied and the controller performs the recording of the image by the second recording mode, the controller is configured to perform the recording of the image, after causing the purge mechanism to perform the purge.

16. The liquid discharging apparatus according to claim 14, wherein the nozzles include recoverable failure nozzles each of which is not set to be the unrecoverable nozzle, the controller is configured to calculate a total value obtained by totaling values of the failure parameter regarding the recoverable failure nozzles, while weighting more greatly as each of the values of the failure parameter of the recoverable failure nozzles is greater; and the purge skip condition includes a condition regarding a value obtained by deducting the total value from the number of the recoverable failure nozzles.

17. The liquid discharging apparatus according to claim 14, wherein the nozzles include recoverable failure nozzles each of which is not set to be the unrecoverable nozzle, the controller is configured to:

increase the value of the failure parameter to be greater as the number of times, in the failure nozzle determination, that the controller continuously determines that the certain nozzle is the failure nozzle is increased; and calculate a total value obtained by totaling values of the failure parameter regarding the recoverable failure nozzles, and the purge skip condition includes a condition regarding a value obtained by deducting the total value from the number of the recoverable failure nozzles.

18. The liquid discharging apparatus according to claim 16, wherein the purge skip condition is a condition that the value obtained by deducting the total value from the number of the recoverable failure nozzles is less than a predetermined nozzle number, the controller is configured to perform the recording of the image onto the recording medium selectively in either one of a first recording mode or a second recording mode of which image quality is higher than that of the first recording mode, in a case that the purge skip condition is satisfied and the controller performs the recording in the first recording mode, the controller is configured to perform the recording of the image without causing the purge mechanism to perform the purge, and in a case that the purge skip condition is satisfied and the controller performs the recording in the second recording mode, the controller is configured to perform the recording of the image after causing the purge mechanism to perform the purge.

19. The liquid discharging apparatus according to claim 1, wherein the nozzles include recoverable failure nozzles each of which is not set to be the unrecoverable nozzle, the controller is configured to calculate a total value obtained by totaling values of the failure parameter regarding the recoverable failure nozzles, while weighting more greatly as each of the values of the failure parameter of the recoverable failure nozzles is greater; and under a condition that the controller determines for each of the nozzles that the value of the failure parameter is less than the threshold value, in a case that the total value is not less than a predetermined value, the controller is configured to: control the purge mechanism to perform the purge; perform the failure nozzle determination for each of the nozzles after the purge, based on the signal from the signal outputting circuit; and update the value of the failure parameter, regarding each of the nozzles, stored in the memory, based on the result of the failure nozzle determination.

20. The liquid discharging apparatus according to claim 1, wherein the nozzles include recoverable failure nozzles each of which is not set to be the unrecoverable nozzle, the controller is configured to:

increase the value of the failure parameter to be greater as the number of times, in the failure nozzle determination, that the controller continuously determines the certain nozzle to be the failure nozzle is increased; and calculate a total value obtained by totaling values of the failure parameter regarding the recoverable failure nozzles, and under a condition that the controller determines for each of the nozzles that the value of the failure parameter is less than the threshold value, in a case that the total value is not less than a predetermined value, the controller is configured to: control the purge mechanism to perform the purge; perform the failure nozzle determination for each of the nozzles after the purge, based on the signal from the signal outputting circuit; and update the value of the failure parameter, regarding each of the nozzles, stored in the memory, based on the result of the failure nozzle determination.

* * * * *